US011125124B2

(12) United States Patent
Lundgren et al.

(10) Patent No.: US 11,125,124 B2
(45) Date of Patent: Sep. 21, 2021

(54) PNEUMATIC SYSTEM FOR AN INTERNAL COMBUSTION ENGINE

(71) Applicant: VOLVO TRUCK CORPORATION, Gothenburg (SE)

(72) Inventors: Staffan Lundgren, Hindås (SE); David Carlson, Mölndal (SE); Claes Kuylenstierna, Mölnlycke (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/960,670

(22) PCT Filed: Jan. 18, 2019

(86) PCT No.: PCT/EP2019/051206
§ 371 (c)(1),
(2) Date: Jul. 8, 2020

(87) PCT Pub. No.: WO2019/141795
PCT Pub. Date: Jul. 25, 2019

(65) Prior Publication Data

US 2020/0347757 A1 Nov. 5, 2020

(30) Foreign Application Priority Data

Jan. 18, 2018 (WO) ..... PCT/EP2018/051180

(51) Int. Cl.
*F01L 9/16* (2021.01)
*F01L 13/06* (2006.01)
(Continued)

(52) U.S. Cl.
CPC ..... *F01L 9/16* (2021.01); *F01L 13/06* (2013.01); *F01L 2013/106* (2013.01);
(Continued)

(58) Field of Classification Search
CPC ..... F01L 9/16; F01L 13/06; F01L 2013/106; F01L 2760/003; F01L 2820/034; F02D 13/0253
(Continued)

(56) References Cited

U.S. PATENT DOCUMENTS 6,223,846 B1 5/2001 Schechter
8,763,571 B2 7/2014 Gilbert et al.
(Continued)

FOREIGN PATENT DOCUMENTS

DE 1159690 B 12/1963
DE 4411934 C1 3/1995
(Continued)

OTHER PUBLICATIONS

International Search Report and Written Opinion dated Apr. 23, 2019 in corresponding International PCT Application No. PCT/EP2019/051206, 11 pages.

*Primary Examiner* — Jorge L Leon, Jr.
(74) *Attorney, Agent, or Firm* — Venable LLP; Jeffri A. Kaminski

(57) ABSTRACT

The invention relates to a system (100) for operating a valve of an internal combustion engine (10), said system comprising a primary fluid circuit (60) configured to define a fluid passageway for circulating a compressible fluid medium there through being operatively connectable to an actuator (92) of an actuated flow control valve (90, 95) of said internal combustion engine, thereby capable of delivering a valve opening force. The system further comprises: a secondary fluid circuit (80) configured to define a secondary fluid passageway for transporting a compressed fluid medium, and having an inlet passage (87) connectable to a cylinder for receiving the compressed fluid medium; and an auxiliary pressurized system (81) comprising a chamber (83) and at least one reciprocating member (82) operable in said
(Continued)

chamber (83), said auxiliary pressurized system (81) being arranged in fluid communication with said secondary fluid circuit (80) and in fluid communication with said primary fluid circuit such that said at least one reciprocating member (82) pressurizes said primary fluid circuit when said compressed fluid medium of the secondary fluid circuit acts on said at least one reciprocating member (82).

20 Claims, 8 Drawing Sheets

(51) Int. Cl.
*F02D 13/02* (2006.01)
*F01L 13/00* (2006.01)

(52) U.S. Cl.
CPC ... *F01L 2760/003* (2013.01); *F01L 2820/031* (2013.01); *F01L 2820/034* (2013.01); *F02D 13/0253* (2013.01)

(58) Field of Classification Search
USPC ..... 123/90.14
See application file for complete search history.

(56) References Cited

U.S. PATENT DOCUMENTS

| | | | | |
|---|---|---|---|---|
| 8,800,510 | B2 | 8/2014 | Carlson et al. | |
| 2006/0207257 | A1* | 9/2006 | Turner | F02D 13/04 60/712 |
| 2013/0098337 | A1* | 4/2013 | Carlson | F01L 9/10 123/48 R |
| 2016/0237866 | A1 | 8/2016 | Hoglund et al. | |

FOREIGN PATENT DOCUMENTS

| | | | |
|---|---|---|---|
| GB | 2402169 | A | 12/2004 |
| WO | 2011162714 | A1 | 12/2011 |

* cited by examiner

PNEUMATIC SYSTEM FOR AN INTERNAL COMBUSTION ENGINE

CROSS-REFERENCE TO RELATED APPLICATIONS

This application is a U.S. National Stage application of PCT/EP2019/051206, filed Jan. 18, 2019, and published on Jul. 25, 2019, as WO 2019/141795 A1, which claims priority to PCT/EP2018/051180, filed on Jan. 18, 2018, all of which is hereby incorporated by reference in its entirety.

TECHNICAL FIELD

The present invention relates to system for operating a valve of an internal combustion engine. In particular, the present invention relates to a pneumatic system for pneumatically operating a valve of an internal combustion engine. In addition, the present invention relates to an internal combustion engine system comprising such a system. The invention also relates to a corresponding method for operating a valve of an internal combustion engine of a vehicle.

The invention is applicable on various types of vehicles, in particularly low, medium and heavy duty vehicles commonly referred to as trucks, but also on buses, construction equipment, working machines e.g. wheel loaders, articulated haulers, dump trucks, excavators and backhoe loaders etc. Although the invention will mainly be described in relation to a truck, the invention is not restricted to this particular, but may also be used in other vehicles such as cars etc.

BACKGROUND

In the field of vehicle, in particularly low, medium and heavy duty vehicles commonly referred to as trucks, there is a continuous development with regards to fuel consumption and the control and configuration of the internal combustion engine system. In particular, the demands on internal combustion engine systems have been increasing and engines are continuously developed to meet the various demands from the market in terms of fuel consumption etc. Reduction of exhaust gases, increasing engine efficiency, i.e. reduced fuel consumption, and lower noise level from the engines are some of the criteria that becomes relevant aspects when selecting a vehicle engine system. One area of particular relevance for reducing fuel consumption is within the field of controlling the supply of fuel and other fluids such as compressed air and exhaust gases to and from the combustion cylinders.

Increased controllability of the supply of compressed air to and removal of exhaust gases from the combustion cylinders may be achieved by using a freely controllable valve system, such as a cam-less valve system. One example of an internal combustion engine system using a so called cam-less engine system is described in US 2016/237866 A1, which discloses an engine having engine valves that are driven by a closed pneumatic pressure fluid circuit. Furthermore, there is provided a compressor operable driven by the crankshaft of the internal combustion engine, and which is used to pressurize the fluid in the closed pneumatic pressure fluid circuit. WO 2011/162714 A1 discloses another example of an internal combustion engine comprising at least two cylinders, the at least two cylinders comprising a working cylinder and a compressor cylinder connected to a compressed-air tank.

Despite the activity in the field, it would be desirable to further improve the fuel consumption in vehicles. In particular, it would be desirable to further improve the fuel consumption in vehicles comprising internal combustion engines utilizing engine valves operated by a closed fluid circuit.

SUMMARY

It is an object of the present invention to provide a system for operating a valve of an internal combustion engine, in which the system at least partly contributes to facilitating fuel consumption by reducing parasitic losses in an internal combustion engine system. This is achieved by a system according to claim 1.

According to a first aspect of the present invention, there is provided a system for operating a valve of an internal combustion engine. The system comprises a primary fluid circuit configured to define a fluid passageway for circulating a compressible fluid medium there through, and being operatively connectable to an actuator of an actuated flow control valve of the internal combustion engine, thereby capable of delivering a valve opening force.

Moreover, the system comprises a secondary fluid circuit configured to define a secondary fluid passageway for transporting a compressed fluid medium, and having an inlet passage connectable to a cylinder for receiving the compressed fluid medium.

Further, the system comprises an auxiliary pressurized system arranged to separate the secondary fluid circuit from the primary fluid circuit. The auxiliary pressurized system is configured to transfer energy from the secondary fluid circuit to the primary fluid circuit. Further, the auxiliary pressurized system comprises a chamber and at least one reciprocating member operable in the chamber. The auxiliary pressurized system is arranged in fluid communication with the secondary fluid circuit and in fluid communication with the primary fluid circuit such that the at least one reciprocating member pressurizes the primary fluid circuit when the compressed fluid medium of the secondary fluid circuit acts on the at least one reciprocating member.

In this manner, the auxiliary pressurized system is configured to transfer energy from the secondary fluid circuit to the primary fluid circuit. In other words, the fluid medium compressed in the cylinder is routed through the inlet passage to the auxiliary pressurized system to act on the reciprocating member, which in turn acts on the compressible fluid medium in the primary fluid circuit, thus raising the pressure in the primary fluid circuit. As such, the auxiliary pressurized system defines an interface between the primary fluid circuit and the secondary fluid circuit. The example embodiments of the invention are particularly useful when the secondary fluid circuit is connected to a cylinder of an internal combustion engine, in which contaminated and dirty compressed air from the engine cylinder is supplied to the auxiliary pressurized system via the secondary fluid circuit, and subsequently used to act on the reciprocating member of the auxiliary pressurized system so as to pressurize the compressible fluid in the primary fluid circuit. To this end, the auxiliary pressurized system is arranged to separate the secondary fluid circuit from the primary fluid circuit so that only energy in the form of pressure is transferred between the two fluid circuits. In this manner, it becomes possible to transfer energy from dirty compressed air in the secondary fluid circuit to the primary fluid circuit in order to operate one or more valves of the internal combustion engine, while ensuring that no dirt is transferred to the primary fluid circuit. Accordingly, only the pressure generated by the auxiliary pressurized system is utilized in the primary fluid circuit. In this context, the transfer of energy from the secondary fluid circuit to the primary fluid circuit is provided in the form of a pressure increase of the compressible fluid medium in the primary fluid circuit, which is subsequently used to deliver the desired opening valve force.

While the example embodiments of the invention can be used both in pneumatically pressurized primary fluid circuits and hydraulic pressurized primary fluid circuits, the following passages mainly refer to a system when the system is a pneumatic system for operating a valve of an internal combustion engine. In this type of pneumatic system, the compressible fluid medium in the primary fluid circuit is a gaseous fluid medium such as air, in particular compressed air. However, the exemplary advantages may likewise be applicable when the system is a hydraulic system. As such, the term "compressible fluid medium", as used herein, typically refers to a gaseous medium such as air, while also including oil, water or any other liquid fluid medium.

Further, the example embodiments of the invention are particularly useful when the compressed fluid medium is any one of compressed air, burnt gases or a mixture thereof. Thus, the term "compressed fluid medium", as used herein, typically refers to compressed air, compressed burnt gases or a mixture thereof.

By the example embodiments of the invention, it becomes possible to reduce the parasitic losses occurring when operating the actuator of the actuated flow control valve of the internal combustion engine by utilizing an additional pressurized system, i.e. the auxiliary pressurized system, for further pressurizing the fluid in the primary fluid circuit of the system based at least partly on energy (e.g. compressed air) generated from a braking force of a cylinder in the event of deceleration or braking of the vehicle. The term parasitic loss is often applied to devices that take energy from the engine in order to enhance the engine's ability to create more energy. In a conventional internal combustion engine system, a mechanically driven compressor may for instance cause parasitic loss. In other words, it becomes possible to reduce the parasitic losses occurring when operating e.g. a pneumatic actuator of a pneumatically actuated flow control valve of the internal combustion engine by minimizing the input of needed energy from a mechanically driven compressor to open the control valve by the exchange of energy generated in the auxiliary pressurized system (the sub-system) upon a deceleration or braking event of the vehicle. Thus, the system also contributes to reduce the engagement need of the mechanically driven compressor. As such, the example embodiments of the system provide a system for reducing the parasitic load of the internal combustion engine system.

The present invention is thus based on energy recovery, i.e. utilizing recuperation of energy, as will be further described below. The system is particularly useful in an internal combustion engine system including a so called cam-less system or cam-less engine configuration, which may use e.g. electro-hydraulic-pneumatic, electro-pneumatic, electro-hydraulic, pneumatic or hydraulic actuators arranged in connection to the flow control valve in order to replace a conventional camshaft. A cam-less system allows for optimizing the circulation of gases in the engines, typically both intake gases and exhaust gases. In particular, a cam-less system allows for optimizing the gas exchange process in an engine.

A cam-less system is typically configured to use a closed primary fluid circuit for delivering valve opening force and counter action spring force by pressure control, e.g. to open the valves against the cylinder pressure and a return spring for each valve. This type of operation or "work" is performed by the mechanically driven compressor (a closed loop pump), which is powered by the combustion engine. The work required for driving the compressor will thus add an additional parasitic load to the engine.

It has been realized that the additional parasitic load, as mentioned above, should be minimized as much as possible in order to further improve fuel consumption of an engine, such as cam-less engine configuration. In some prior art system, a magnitude of the parasitic losses can be reduced during the actuation of the control valve, but there is hitherto no system configured to reduce the parasitic losses by utilizing a recuperation of energy. Further, it has been observed that the pressure generated in the event of a deceleration or braking of the vehicle due to the braking force may be well suited for being delivered to a pressurized sub-system (the auxiliary pressurized system) for subsequent use thereof.

In particular, the example embodiments allows for reducing parasitic losses by arranging the auxiliary pressurized system in fluid relationship with the cylinder of the internal combustion engine, and further connecting the auxiliary pressurized system in communication with the primary fluid circuit. In this manner, a sub-pneumatic gas system, i.e. the auxiliary pressurized system, is adapted to pressurize the fluid in the primary fluid circuit, corresponding to a closed loop gas system.

As the auxiliary pressurized system typically operates by receiving compressed air generated from brake recovery recuperation, it becomes possible to reduce parasitic losses in an effective manner. That is, during vehicle deceleration and braking vehicle events a part of the braking force is generated by using one or more of the cylinder intake valves of the cylinder in a compressor mode, or more specifically, by using one or more of the engine cylinders in compression mode. Typically, the cylinder intake valve is opened as in a normal event for an intake stroke, and then, late in the compression stroke, a separate or external valve is opened on the intake side of the engine, which is intended to be operatively connected to the auxiliary pressurized system to deliver the compressed air to the auxiliary pressurized system for effecting an increase in pressure. When this operation is performed in the auxiliary pressurized system, the increased pressure obtained by means of the movement of the reciprocating member is provided via the secondary fluid circuit to the primary fluid circuit so as to reduce the required energy of the primary fluid circuit by reducing the engagement need of the compressor.

To this end, the air compressed in the cylinder is routed through the inlet passage to the auxiliary pressurized system and acts on the reciprocating member, which in turn acts on the air in the primary fluid circuit, thus raising the pressure in the primary system.

An advantage of the example embodiments of the invention is thus that the internal combustion engine system can be operated with less required compressed air work, i.e. it becomes possible to raise the general pressure level in the system so that the compressor can operate in a more efficient manner. Thereby, the system can reduce the parasitic losses of the cam-less system. The fuel consumption of the vehicle will hereby also be reduced as a consequence of a more efficient system.

Further, by having the primary fluid circuit and the secondary fluid circuit separated by the auxiliary pressurized system, it becomes possible to pressurize the primary fluid circuit in a more efficient manner, as mentioned above, while ensuring that no dirt or particles are supplied to the closed and clean primary fluid circuit, which would have been at risk if the relatively more dirty compressed fluid medium from the engine cylinder would have been directly supplied to the primary fluid circuit from the engine cylinder.

It should be noted that when the secondary fluid circuit is connected to the cylinder, the secondary fluid circuit is arranged in fluid communication with the cylinder via the inlet passage of the secondary fluid circuit.

While the auxiliary pressurized system can be arranged to separate the secondary fluid circuit from the primary fluid circuit in several different manners, the movable reciprocating member is typically designed so that no fluid medium can be transferred in-between the reciprocating member and the inner surfaces of the chamber arranged to cooperate with the reciprocating member. Hence, the reciprocating member is movably arranged in the chamber to provide a transfer of energy between the secondary fluid circuit and the primary fluid circuit, while ensuring that no exchange of fluid medium is possible between the secondary fluid circuit and the primary fluid circuit.

By way of example, the secondary fluid circuit is separated from the primary fluid circuit by the reciprocating member and the chamber forming a fluid-tight configuration between the primary fluid circuit and the secondary fluid circuit. In other words, the term "separate", as used herein in connection to the auxiliary pressurized system, generally refers to an arrangement adapted to prevent a transfer of fluid medium from the secondary fluid circuit to the primary fluid circuit.

According to one example embodiment, the primary fluid circuit comprises a first controllable valve assembly for regulating the flow of the compressible fluid medium in the primary fluid circuit. By way of example, the first controllable valve assembly is arranged to regulate the flow of compressible fluid medium between the primary fluid circuit and the auxiliary pressurized system. That is, the first controllable valve assembly is typically configured to either permit a flow of the compressible fluid medium from the primary fluid circuit to the auxiliary pressurized system or permit a flow of compressed fluid medium from the auxiliary pressurized system to the primary fluid circuit. The first controllable valve assembly can be arranged in the primary fluid circuit at several different locations depending on the design of the primary fluid circuit. By way of example, the first controllable valve assembly is arranged in a low-pressure side of the primary fluid circuit. In this manner, the fluid communication between the auxiliary pressurized system and the low-pressure side of the primary fluid circuit is further improved. Hence, according to one example embodiment, the first controllable valve assembly is arranged to regulate the flow of compressible fluid medium between the low-pressure side of the primary fluid circuit and the auxiliary pressurized system.

Typically, although strictly not required, the primary fluid circuit comprises a return passage to the auxiliary pressurized system for transporting compressible fluid medium to a first part of the chamber arranged in fluid communication with the primary fluid circuit, and wherein the return passage is connected to the first controllable valve assembly. By way of example, the first controllable valve assembly is arranged to regulate the transfer of compressible fluid medium from the return passage to the first part of the chamber of the auxiliary pressurized system. In this manner, the primary fluid circuit is arranged to direct a flow of compressible fluid medium to the auxiliary pressurized system, thereby enabling the auxiliary pressurized system to pressurize the compressible fluid medium from the primary fluid circuit, as described above. The compressed fluid medium (transferred from the primary fluid circuit and compressed in the auxiliary pressurized system) is subsequently transferred from the auxiliary pressurized system to the primary fluid circuit.

The first controllable valve assembly may be any one of a flow control valve, as described further herein, or a combination of a number of check valves, non-return valves or the like. If the controllable valve assembly comprises a number of check valves, each valve is arranged to regulate the flow of compressible fluid medium in a given direction in the primary fluid circuit. These types of valves may for instance be provided as conventional poppet type valves. Other combinations of valves are also conceivable, such as a combination of a flow control valve and a non-return valve. The flow control valve is typically operable by a control unit, as further described herein. Thus, the controllable valve assembly may either be a passive valve assembly or an active valve assembly.

According to an example embodiment, the secondary fluid circuit comprises a first intake valve disposed in the inlet passage and upstream of the auxiliary pressurized system. The first intake valve is configured to prevent discharge of compressed fluid medium from the secondary fluid circuit when the cylinder is not operated as a compressor. Hence, the compressed fluid medium is only permitted to flow from the cylinder to the auxiliary pressurized system.

According to an example embodiment, the auxiliary pressurized system comprises an additional chamber and an additional reciprocating member operable in the additional chamber. The additional reciprocating member is capable of pressurizing the primary fluid circuit when the compressed fluid medium of the secondary fluid circuit acts on the additional reciprocating member, wherein the chamber and the additional chamber are arranged in parallel to each other. By way of example, the chamber and the additional chamber are arranged in parallel to each other so as to pressurize the primary fluid circuit in an alternated manner.

In this manner, it becomes possible to increase the efficiency of the secondary fluid circuit as the pressure to the primary fluid circuit can be provided with fewer interruptions.

According to an example embodiment, the system comprises a second valve disposed downstream of the auxiliary pressurized system, and configured to control the pressure from the auxiliary pressurized system. In addition, if the auxiliary pressurized system includes two reciprocating members, the second valve can be configured to control the pressure from the auxiliary pressurized system and between the chambers.

Typically, although not strictly required, the reciprocating member is any one of a diaphragm membrane or a reciprocating piston member. In other words, either one of the reciprocating member and the additional reciprocating member may be a diaphragm membrane or a reciprocating piston member. When the reciprocating member is a reciprocating piston member, the auxiliary pressurized system is a reciprocating system operated and driven by the compressed fluid medium supplied to the auxiliary pressurized system via the inlet passage.

When the reciprocating member is a diaphragm membrane, the auxiliary pressurized system is a diaphragm membrane system. In a diaphragm membrane system, the compression of gas, such as air occurs by means of a flexible membrane, instead of an intake element. The back and forth moving membrane can be driven by a rod and a crankshaft mechanism. Also, when the reciprocating member is a diaphragm membrane, the auxiliary pressurized system is a diaphragm membrane system operated and driven by the compressed fluid medium supplied to the auxiliary pressurized system via the inlet passage.

According to one example embodiment, the secondary fluid circuit comprises a second controllable valve assembly for regulating the transfer of compressed fluid medium from the secondary fluid circuit to the auxiliary pressurized system. Typically, the second controllable valve assembly is arranged to regulate the transfer of compressed fluid medium from the inlet passage of the secondary fluid circuit to the auxiliary pressurized system. In addition, or alternatively, the second controllable valve assembly is arranged to regulate the transfer of compressed fluid medium from the auxiliary pressurized system to an outlet passage of the secondary fluid circuit. In other words, the second controllable valve assembly is configured to regulate the direction of the flow of the compressed fluid medium between the secondary fluid circuit and the auxiliary pressurized system. In this manner, the second controllable valve assembly is operable to either direct compressed fluid medium from the secondary fluid circuit to the auxiliary pressurized system, enabling the auxiliary pressurized system to pressurize the compressible fluid medium in the primary fluid circuit, or operable to permit a discharge of the compressed fluid medium from the auxiliary pressurized system via the secondary fluid circuit (which will typically occur when new compressible fluid medium is transferred from the primary fluid circuit to the auxiliary pressurized system). That is, the second controllable valve assembly is typically configured to either permit a flow of the compressed fluid medium from the secondary fluid circuit to the auxiliary pressurized system or permit a discharge of compressed fluid medium from the auxiliary pressurized system via the secondary fluid circuit.

According to one example embodiment, the secondary fluid circuit comprises a discharge fluid medium passage in fluid communication with a second part of the chamber of the auxiliary pressurized system. In this example, the second controllable valve assembly is arranged to regulate the flow of compressed fluid medium in the discharge fluid medium passage. In this manner, the second controllable valve assembly is arranged to permit the compressed fluid medium to discharge from the auxiliary pressurized system via the discharge fluid medium passage. Typically, although strictly not required, the discharge fluid medium passage may comprise the second controllable valve assembly arranged to permit the compressed fluid medium to discharge from the auxiliary pressurized system. In this context, the compressed fluid medium refers to the compressed fluid medium contained in the secondary fluid circuit. As mentioned above in relation to the first controllable valve assembly, also the second controllable valve assembly may be any one of a flow control valve or a combination of a number of check valves, non-return valves or the like. These types of valves may for instance be provided as conventional poppet type valves. Other combinations of valves are also conceivable, such as a combination of a flow control valve and a non-return valve. The flow control valve is typically operable by a control unit, as further described herein. Thus, the second controllable valve assembly may either be a passive valve assembly or an active valve assembly.

According to one example embodiment, the secondary fluid circuit further comprises a fluid medium storage device disposed between the inlet passage and the auxiliary pressurized system. Typically, the fluid medium storage device is arranged to accommodate a portion of the compressed fluid medium. By the provision of having a fluid medium storage device, compressed air generated in the cylinder during a braking vehicle event can be transferred to the secondary fluid circuit and stored in the fluid medium storage device for the purposes of pressurizing the compressible fluid medium in the primary fluid circuit at a later stage.

According to one example embodiment, when the secondary fluid circuit comprises the second controllable valve assembly, the second controllable valve assembly may be further arranged to regulate a transfer of compressed fluid medium from the fluid medium storage device to the auxiliary pressurized system. By way of example, the second controllable valve assembly is arranged in-between the fluid medium storage device and the auxiliary pressurized system.

Further, it is to be noted that the second controllable valve assembly may comprise a number of valves, i.e. sub-valves, arranged at different locations in the secondary fluid circuit. According to one example embodiment, the second controllable valve assembly is arranged to both regulate discharge of the compressed fluid medium from the auxiliary pressurized system and arranged to regulate transfer of compressed fluid medium from the fluid medium storage device to the auxiliary pressurized system.

In an example embodiment when the system comprises both the first controllable valve assembly in the primary fluid circuit and the second controllable valve assembly in the secondary fluid circuit, the system may be operable to deliver the opening force to the valve in an even more controlled manner.

According to an example embodiment, the system comprises a control unit configured to operate the auxiliary pressurized system upon a braking vehicle event or a vehicle deceleration event. In addition, or alternatively, the control unit is configured to operate the auxiliary pressurized system during the braking vehicle event or the vehicle deceleration event.

The control unit may also control the internal combustion engine to be operated by means of the auxiliary pressurized system upon the braking vehicle event or the vehicle deceleration event.

The control unit may also be arranged to control the first controllable valve assembly in the primary fluid circuit and the second controllable valve assembly in the secondary fluid circuit.

Typically, the control unit is configured to receive a signal indicative of a braking operation for the vehicle; and control the internal combustion engine system to be operated by means of the auxiliary pressurized system upon the braking vehicle event or the vehicle deceleration event.

As described above, the braking operation typically relates to an engine braking of the vehicle. Hereby, surplus energy from this operation can be used for delivering valve opening force by using the surplus energy and delivering compressed air from one of the engine cylinders to the auxiliary pressurized system in order to effect a movement of the reciprocating member to increase the pressure on the other side of the secondary fluid circuit, i.e. downstream of the reciprocating member, which in turn acts on the air in the primary fluid circuit, thus raising the pressure in the primary fluid circuit, as mentioned above. An advantage is thus that an improved utilization of energy is provided.

According to one example embodiment, when the system comprises the control unit, the fluid medium storage device and the second flow controllable valve assembly, as described above, the control unit may be arranged to operate the system to pressurize the primary fluid circuit in an intermittently manner. That is, the control unit is arranged to control the second controllable valve to supply compressed fluid medium to the auxiliary pressurized system from the fluid medium storage device. By way of example, the control unit is arranged to control the second controllable valve to supply compressed fluid medium to the auxiliary pressurized system from the fluid medium storage device upon receiving a signal indicating that the actuator is required to deliver the valve opening force, as described above.

The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device. According to one example embodiment, the control unit is an electronic control unit.

According to one example embodiment, the primary fluid circuit has a low-pressure side and a high-pressure side. In this example, the high-pressure side is operatively connectable to the actuator of the actuated flow control valve of the internal combustion engine. Moreover, in this example, the reciprocating member is capable of pressurizing at least one of the low-pressure side and the high-pressure side of the primary fluid circuit when the compressed fluid medium of the secondary fluid circuit acts on the at least one reciprocating member. Typically, although strictly not required, the low-pressure side and the high-pressure side of the primary fluid circuit are separated by an arrangement of a compressor in the primary fluid circuit.

According to one example embodiment, the system further comprises a compressor arranged in-between a low-pressure side and a high-pressure side of the primary fluid circuit. The compressor is configured to deliver a fluid medium pressure to the high-pressure side of the primary fluid circuit. By way of example, the compressor is a mechanically driven compressor. Alternatively, the compressor is an electrically driven compressor. In addition, or alternatively, the fluid medium pressure to the high-pressure side of the primary fluid circuit compressor can be delivered by an exhaust turbine, or any other type of compressor configuration.

The mechanically driven compressor may typically be operated in a two stroke fashion, but can be operated in several different manners, including e.g. the two stroke fashion, a four stroke fashion, a six stroke fashion etc. The compressor is typically, although not strictly necessary, driven by a crankshaft of the engine system. Typically, although not strictly required, the mechanically driven compressor may comprise a reciprocating member. The reciprocating member can be any one of a diaphragm membrane or a reciprocating piston member. In a compressor when the mechanically driven compressor comprises a reciprocating piston member, the compressor equals a reciprocating compressor. The details and configuration of a reciprocating compressor is a well-known type of compressor.

In another example embodiment, the example embodiments of the system can be activated by a so called cylinder deactivation. That is, the combustion in one of the cylinders of the engine, which is operatively connected to the secondary fluid circuit, is deactivated and instead the corresponding cylinder is operated as a compressor. In an example, when several cylinders are operatively connected to the secondary fluid circuit, the combustion in the corresponding several cylinders can be deactivated and instead operated as compressors. The several cylinders may either operate as compressors simultaneously, or operate as compressors in an alternated manner.

Typically, the actuated flow control valve may be any one of a pneumatic flow control valve, an electro-pneumatic flow control valve, a hydraulic flow control valve, an electro-hydraulic flow control valve, a pneumatic-hydraulic flow control valve, an electro-pneumatic-hydraulic flow control valve or the like.

The actuated flow control valve can be controlled in various manners. Typically, although not strictly necessary, the actuated flow control valve has a corresponding actuator operatively connected to a valve member, wherein the actuator is configured to operate the valve member by means of pneumatic pressure. Hence, in some example embodiments, the actuated flow control valve is a pneumatically actuated flow control valve. As such, each valve member has its own actuator controlling the valve position and timing. However, in other example embodiments, a number of valve members may be controlled by common actuator. The actuator is typically configured to control the opening and closure of the valve at a given point in time. By way of example, the actuator is typically configured to control the opening and closure of the valve at a given point in time by receiving a signal from the control unit or the like.

It is to be noted that the term "pneumatic flow control valve" or "pneumatically actuated flow control valve", as used herein, typically refers to a pneumatically controlled flow control valve operated by a pneumatic actuator. The pneumatic flow control valve can also be provided in the form an electro-pneumatic flow control valve, an electro-pneumatic-hydraulic flow control valve or the like. Generally, the pneumatic flow control valve is configured to regulate the flow of a fluid medium passing through the valve, such as regulating the flow of compressed air passing through the valve. The pneumatic flow control valve typically comprises the pneumatic actuator, which is configured to operate the valve by means of pneumatic pressure. The operation and configuration of the pneumatically actuated flow control valve can vary depending on type of valve, and there are several different types of valves available for providing the operation described above in connection with the example embodiments of the system.

In another example embodiment, the actuated flow control valve is a hydraulically actuated flow control valve with a hydraulic actuator.

According to one example embodiment, the system is a pneumatic system comprising any one of the example embodiments as mentioned above. Thus, there is provided a pneumatic system for operating a pneumatic valve of an internal combustion engine. The system comprises a primary fluid circuit configured to define a fluid passageway for circulating a compressible fluid medium there through and being operatively connectable to a pneumatic actuator of a pneumatically actuated flow control valve of the internal combustion engine, thereby capable of delivering a valve opening force. Moreover, the system comprises a secondary fluid circuit configured to define a secondary fluid passageway for transporting a compressed fluid medium and in fluid communication with at least one cylinder via an inlet passage to receive the compressed fluid medium from the at least one cylinder. Further, the pneumatic system comprises an auxiliary pressurized system comprising a chamber and at least one reciprocating member operable in the chamber. The auxiliary pressurized system is arranged in fluid communication with the secondary fluid circuit and operatively connected to the primary fluid circuit such that the at least one reciprocating member is capable of pressurizing the primary fluid circuit when the compressed fluid medium of the secondary fluid circuit acts on the at least one reciprocating member.

According to a second aspect, there is provided an internal combustion engine system comprising the system according to any one of the preceding example embodiments of the system according to the first aspect of the invention. Typically, the primary fluid circuit of the system is connected to the actuator of the actuated flow control valve of the internal combustion engine. Moreover, the internal combustion engine system comprises at least one cylinder operatively connected to the inlet passage of the secondary fluid circuit of the system.

Further effects and features of the second aspect are largely analogous to those described above in relation to the first aspect. In detail, features described above in relation to the first aspect can equally well be combined with features of the second aspect.

It should be readily appreciated that the internal combustion engine thus typically comprises at least one flow control valve and a corresponding actuator for the flow control valve. However, the internal combustion engine may typically comprise a number of flow control valves having corresponding actuators.

In one example embodiment, when the system is a pneumatic system comprising any one of the preceding example embodiments of the system according to the first aspect of the invention, there is provided an internal combustion engine system comprising the pneumatic system, and at least one cylinder operatively connected to the inlet passage of the secondary fluid circuit of the system.

Typically, there is provided an internal combustion engine system, wherein the at least one cylinder is a cylinder of the internal combustion engine. In addition, the cylinder is used as an air compressor during a braking vehicle event or a vehicle deceleration event. In other words, in this example embodiment, the compressed fluid medium is transferred from one or more cylinders of the internal combustion engine comprising the one or more flow control valves, as mentioned above.

Alternatively, there is provided an internal combustion engine system, wherein the at least one cylinder is a separate braking compressor cylinder operatively connected to the inlet air passage.

According to a third aspect, there is provided a vehicle comprising a system according to any one of the example embodiments and/or features relating to the first aspect of the invention and/or an internal combustion engine system according to any one of the example embodiments and/or features relating to the second aspect of the invention.

Further effects and features of the third aspect are largely analogous to those described above in relation to the first aspect and/or the second aspect. Features described above in relation to the first aspect and/or the second aspect can equally well also be combined with features of the third aspect.

In one example embodiment, when the system is a pneumatic system comprising any one of the preceding example embodiments of the system according to the first aspect of the invention, there is provided a vehicle comprising the pneumatic system.

According to a fourth aspect, there is provided a provided a method for operating a valve of an internal combustion engine by means of a system according any one of the example embodiments described above. In addition, the method comprises the steps of:

- operating the at least one cylinder as a fluid medium compressor during vehicle braking or vehicle deceleration;
- supplying compressed fluid medium from the at least one cylinder to the auxiliary pressurized system via the inlet passage;
- operating the auxiliary pressurized system by means of the compressed fluid medium supplied to the auxiliary pressurized system; and
- pressurizing the primary fluid circuit via the fluid communication between the auxiliary pressurized system and the primary fluid circuit.

An advantage is thus, as described above, that the system can be operated to supply compressed air to the internal combustion engine in order to reduce the parasitic losses as described above in relation to the first aspect of the invention. Also, the method is suitable for combining with an operation of a pneumatic valve, electro-pneumatic valve, or electro-pneumatic-hydraulic valve in a cam-less engine system. That is, the method is particularly useful for providing a pressure to an actuator of an engine inlet valve or an engine outlet valve (being a pneumatic valve, an electro-pneumatic valve or an electro-pneumatic-hydraulic valve) in a cam-less engine system. The method may also be used for providing a pressure to an actuator of a hydraulic or electro-hydraulic valve.

According to one exemplary embodiment, the fluid communication between the auxiliary pressurized system and the primary fluid circuit is at least partly provided by means of an outlet passage.

Further effects and features of the fourth aspect are largely analogous to those described above in relation to any one of the first aspect, second aspect and third aspect. As for the other aspects, features described above in relation to the other aspects can equally well be combined with features of the fourth aspect.

By way of example, the step of pressurizing the primary fluid circuit via the outlet passage comprises the step of pressurizing at least one of a low-pressure side and a high-pressure side of the primary fluid circuit via the outlet passage.

According to a fifth aspect, there is provided a computer program comprising program code means for performing the steps of the fourth aspect when the program is run on a computer.

According to a sixth aspect, there is provided a computer readable medium carrying a computer program comprising program means for performing the steps of the fourth aspect when the program means is run on a computer.

Effects and features of the fifth and sixth aspects are largely analogous to those described above in relation to the first aspect.

It is to be noted that although the example embodiments of the present invention sometimes refer to a method for operating a valve of an internal combustion engine, the method is typically intended for operating a plurality of valves of an internal combustion engine. Thus, in the context of the example embodiments of the present invention, it is to be noted that singular words such as "a" and "an" generally mean "one or more".

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
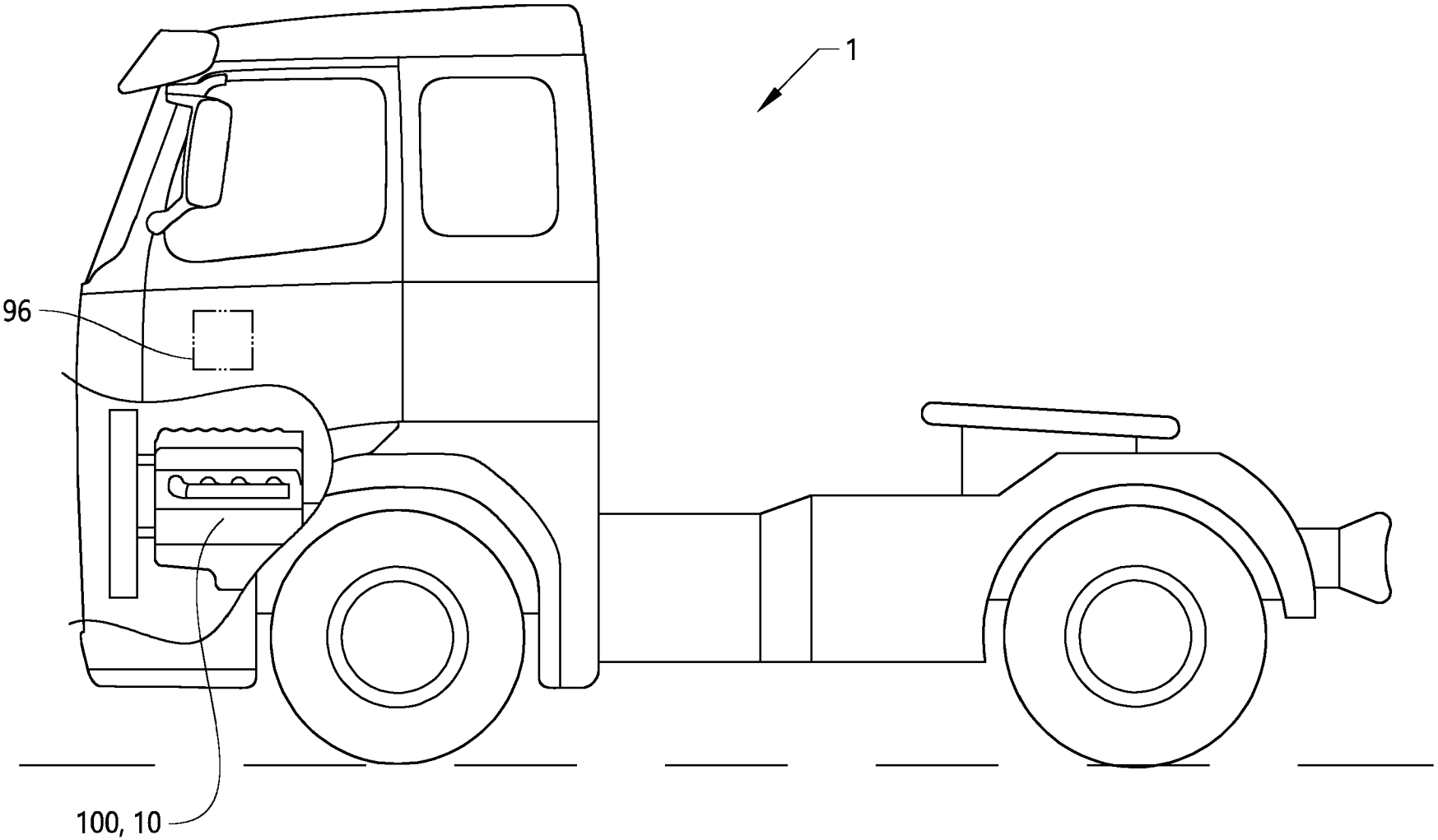
FIG. 1 is a lateral side view illustrating an example embodiment of a vehicle in the form of a truck, in which the vehicle comprises a system for operating a valve of an internal combustion engine of the vehicle according to the present invention.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With particular reference to FIG. 1, there is provided a vehicle 1 in the form of a truck. The vehicle 1 comprises an engine in the form of an internal combustion engine system 10 as will be described further below in relation to the description of e.g. FIGS. 2*a*-2*d*, 3, 4 and 5. In addition, the internal combustion engine system 10 comprises a pneumatic system 100 according to any one of the example embodiments as described below in relation to FIGS. 2*a* to 2*d*, 3, 4 and 5. The internal combustion engine system 10 is typically propelled by e.g. a conventional fuel such as diesel. It should be noted that the vehicle can be of a variety of alternative types, e.g. it may be a car, a bus, or a working machine such as a wheel loader or the like.

Figure 4:
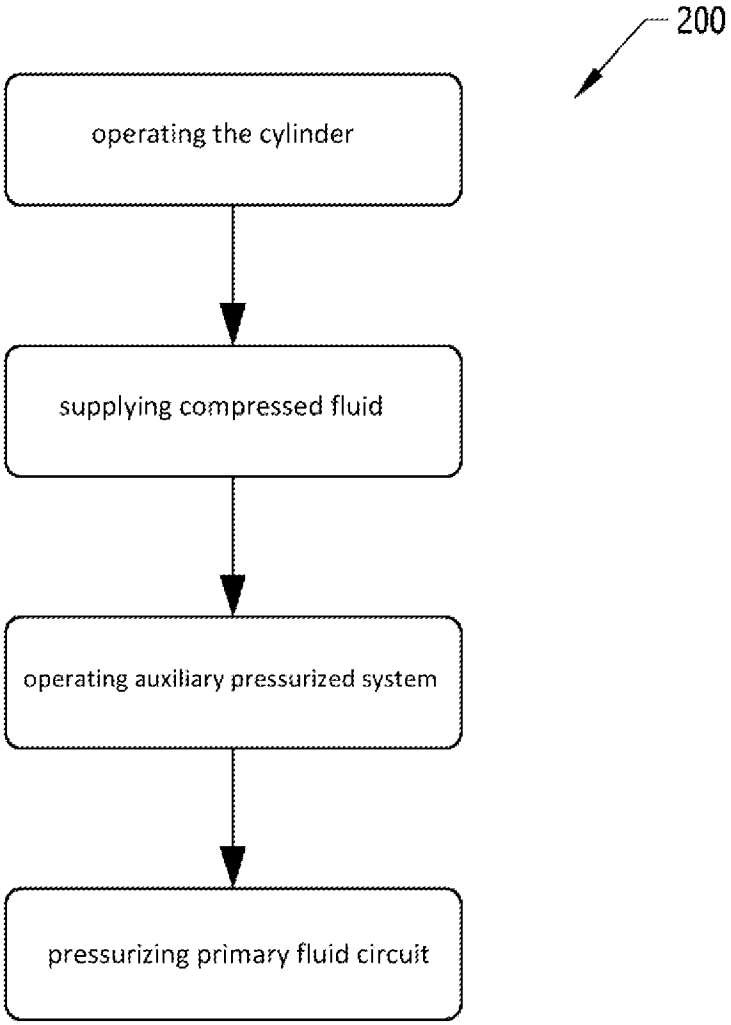
FIG. 4 is a flow chart illustrating an example embodiment of a method for controlling an internal combustion engine system according to the present invention.

The pneumatic system 100 is adapted to be operated according to a method of an example embodiment of the present invention, as described in more detail with respect to FIG. 4. In addition, in this example, the pneumatic system 100 comprises a control unit 96 to perform the operational steps of the method according to the example embodiments as described herein.

Figure 2A:
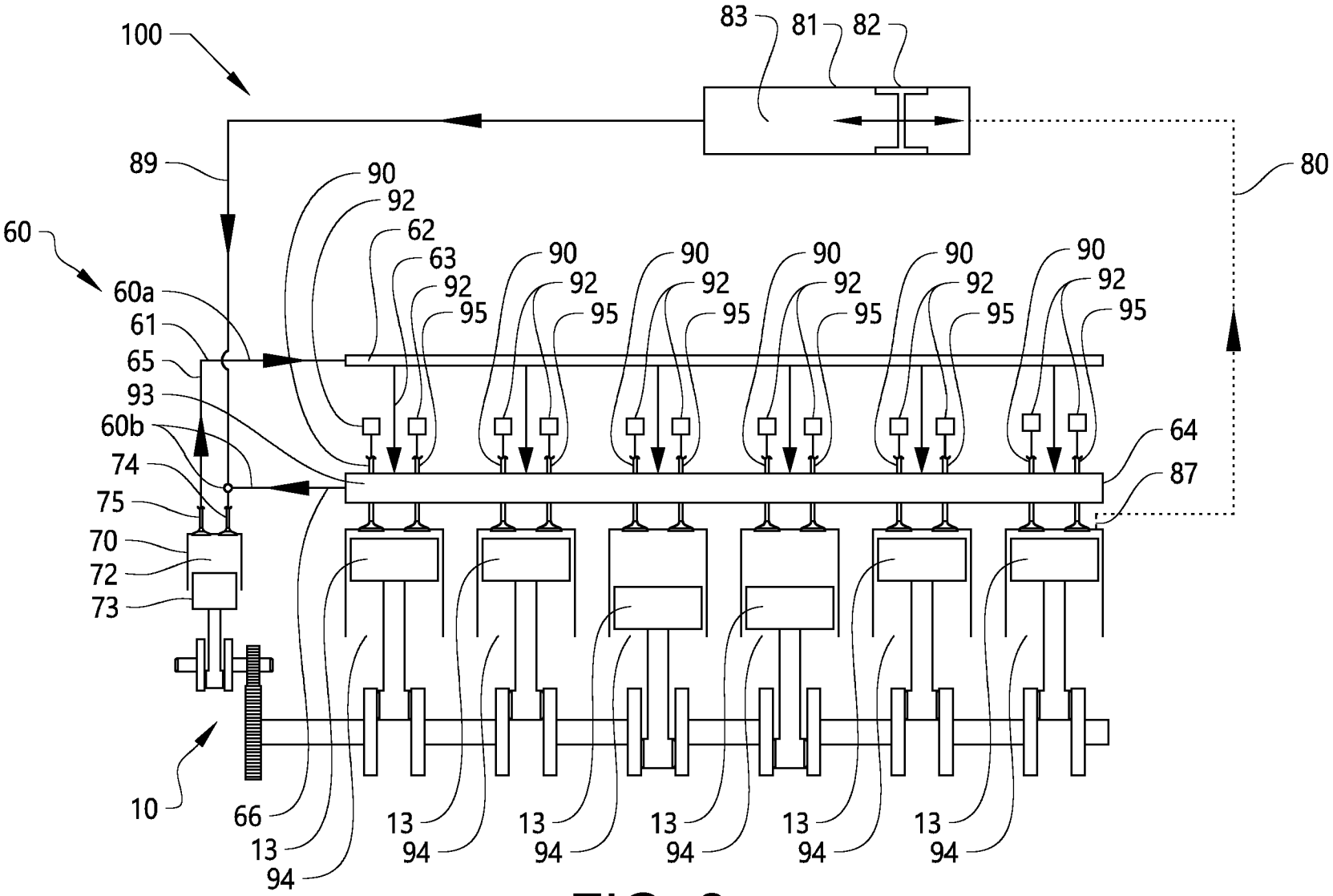
FIG. 2*a* is a schematic illustration of an example embodiment of a system for operating a valve of an internal combustion engine of the vehicle according to the present invention.

With reference to FIG. 2*a*, a schematic illustration of an example embodiment of a pneumatic system 100 for operating a valve of the internal combustion engine 10 of the vehicle is depicted. In particular, the system 100 is intended for supplying compressible fluid medium, such as compressed air, to the internal combustion engine 10 of the vehicle 1. According to the example embodiment depicted in FIG. 2*a*, the internal combustion engine system 10 comprises a number of combustion cylinders 94. Each one of the combustion cylinders 94 comprises a reciprocating combustion piston 13, i.e. the reciprocating combustion piston is housed within the combustion cylinder 94 to operate in a reciprocating motion between an upper end, which is also commonly referred to as top dead center (TDC) and a lower end, which is also commonly referred to as bottom dead center (BDC). Each one of the combustion cylinders 94 further comprises an inlet valve 90 in the form of a pneumatically actuated flow control valve, at which pressurized gas, typically in the form of pressurized air is controllably provided into the combustion cylinder 94 by operating a pneumatic actuator 92 of the pneumatically actuated flow control valve 90. The combustion cylinder 94 also comprises an outlet valve 95 through which compressed combustion gas is controllably exhausted from the combustion cylinder 94. By way of example, the outlet valve 95 is a pneumatically actuated flow control valve adapted to regulate the flow of compressed combustion gas passing through the valve. As illustrated in FIG. 2*a*, also the outlet valve 95 is actuated by operating a pneumatic actuator 92 of the pneumatically actuated flow control valve 95.

The combustion cylinder 94 is typically operated in a four stroke fashion. However, the combustion cylinder 94 may be operated in several different manners, e.g. a two stroke fashion, four stroke fashion, six stroke fashion etc.

It should be appreciated that although the example embodiment depicted in the FIG. 2*a* comprises six combustion cylinders 94, the internal combustion engine may in other variants comprise another number of combustion cylinders, e.g. four, eight, or even one in some other types of vehicles.

Also, each of the combustion cylinders 94 typically comprises a fuel injection system (not shown) for providing fuel into the combustion cylinder 94 for combustion therein.

In connection with the combustion cylinders 94, there is disposed a primary fluid circuit 60 configured to define a fluid passageway for circulating compressed air there through. It may be noted that the compressible fluid medium in the primary fluid circuit is herein generally denoted with reference 60*d*, as indicated in e.g. FIG. 2*c* illustrating additional optional parts of the system in FIG. 2*a*. Thus, the system 100 also comprises the primary fluid circuit configured to define the fluid passageway for circulating compressed air there through. The primary fluid circuit is operatively connectable to one or more actuator(s) 92 of corresponding to one or more actuated flow control valve(s) 90, 95 of the internal combustion engine, thereby capable of delivering a valve opening force. In particular, the primary fluid circuit 60 has a low-pressure side 60*b* and a high-pressure side 60*a* being operatively connectable to one or more actuator(s) 92 of corresponding one or more actuated flow control valve(s) 90, 95 of the internal combustion engine, thereby capable of delivering a valve opening force. It should be readily appreciated that although the description sometimes only refers to one actuated flow control valve and one actuator, the system and method as described herein may generally be configured to operate a plurality of pneumatic actuators 92 of a plurality of corresponding pneumatically actuated flow control valves 90, 95.

In this example, the primary fluid circuit is operatively connected to one or more actuator(s) 92 of corresponding one or more inlet actuated flow control valve(s) 90 of the internal combustion engine, thereby capable of delivering a valve opening force to the one or more inlet valves 90. In this example, the primary fluid circuit is also operatively connected to one or more actuator(s) 92 of corresponding one or more outlet actuated flow control valve(s) 95 of the internal combustion engine, thereby capable of delivering a valve opening force to the one or more outlet valves 95.

If the primary fluid circuit is operatively connected to one or more actuator(s) 92 of corresponding one or more inlet actuated flow control valve(s) 90 and to one or more actuator(s) 92 of corresponding one or more outlet actuated flow control valve(s) 95, the compressed fluid medium is typically directed to the various inlet valves 90 and the outlet valves 95 by one or more valves.

As illustrated in FIG. 2*a*, a compressor 70 is typically arranged in-between the low-pressure side and the high-pressure side of the primary fluid circuit 60. Thus, the system also comprises the compressor 70, configured to deliver a fluid medium pressure to the high-pressure side 60*a* of the primary fluid circuit. By way of example, the compressor 70 is a mechanically driven compressor. As depicted in e.g. FIG. 2*a*, the primary fluid circuit is operatively connected to the mechanically driven compressor 70, which is configured to deliver a pneumatic pressure to the primary fluid circuit 60. In addition, the primary fluid circuit 60 is operatively connected to the pneumatic actuator 92 of a pneumatically actuated flow control valve 90, 95, which will be further described below. One example of a mechanically driven compressor is a reciprocating compressor, which is a well-known type of compressor.

In this example embodiment, the compressible fluid medium is compressed air. The compressed air may have different types of characteristics, i.e. temperature and pressure, depending on the type of system, engine and vehicle. Also, the temperature of the compressed air typically varies in relation to prevailing driving conditions of the vehicle. By way of example, the compressed air has an ambient temperature. It is to be noted that the primary fluid circuit typically includes the compressed air itself. Hence, the compressed air in this example is contained in the primary fluid circuit 60, i.e. the fluid passageway contains the compressed air. Accordingly, in the primary fluid circuit 60 there is a portion of compressed air being transportable, typically with the aid of the compressor 70.

It should be readily appreciated that the flow of compressed air is in a direction from the compressor 70 to the flow control valve(s) 90, 95 and then in a direction from the flow control valve(s) 90, 95 to the compressor 70, as indicated by the arrows in e.g. FIG. 2*a*.

The primary fluid circuit 60 can be designed in several different ways depending on type of engine and type of vehicle etc. In the example described in relation to FIG. 2*a*, the primary fluid circuit 60 defining the fluid passageway 61 further comprises a fluid inlet passage 65, a fluid compartment 62, a number of fluid intermediate passages 63, an inter-connecting fluid passage 64 and a return fluid passage 66. The primary fluid circuit 60 thus has the fluid passageway 61 passing through the fluid inlet passage 65, the fluid compartment 62, the number of fluid intermediate passages 63, the inter-connecting fluid passage 64 and the return fluid passage 66. The fluid inlet passage 65 extends between the compressor 70 and the fluid compartment 62. The fluid compartment 62 is configured for containing compressed air, and thus has an inner volume for containing the compressed air. In this manner, the fluid compartment 62 is arranged to store the compressed air for a certain time. However, it is to be noted that the inner volume of the fluid passageway is typically sufficient for containing the compressed air. Thus, the extra fluid compartment 62 is only optional, and not strictly required. The fluid compartment 62 is operatively connected to and in fluid communication with one or more fluid intermediate passages 63. Each one of the fluid intermediate passages 63 is operatively connected and in fluid communication with a corresponding pneumatically actuated flow control valve 90, 95 via a corresponding pneumatic actuator 92. In addition, each one of the pneumatic actuators 92 is operatively connected and in fluid communication with the return fluid passage 66. Each one of the pneumatic actuators 92 is typically in fluid communication with the return fluid passage 66 via the inter-connecting fluid passage 64, as illustrated in e.g. FIG. 2*a*. Accordingly, by the above arrangement, each one of the pneumatically actuated flow control valves 90, 95 can be operated by pressurizing the corresponding pneumatic actuators 92, respectively, such that a valve opening force is provided to the corresponding flow control valves 90, 95 by means of providing compressed air in the primary fluid circuit. Typically, the high pressure side 60*a* of the primary fluid circuit includes the fluid inlet passage 65, the fluid compartment 62, the number of fluid intermediate passages 63, the inter-connecting fluid passage 64, while the low pressure side 60*b* includes the return fluid passage 66 because the high-pressure side is used for pressurizing any one of the valves 90, 95 via corresponding pneumatic actuators 92. The high pressure side and the low pressure side form a closed loop circuit.

In addition, the return fluid passage 66 connects the fluid intermediate passage(s) 63 with the compressor 70. As described in more detail below in relation to FIG. 2*c*, the return fluid passage 66 may connect to the compressor via a first controllable valve assembly.

Accordingly, the primary fluid circuit is a closed loop circuit. It is to be noted that the components above, i.e. the fluid inlet passage 65, the fluid compartment 62, the number of fluid intermediate passages 63, the inter-connecting fluid passage 64 and the return fluid passage 66 provides one example of a primary fluid circuit having a fluid passageway for circulating compressed air there through, and which is operatively connectable to the pneumatic actuator of the pneumatically actuated flow control valve.

As mentioned above, the primary fluid circuit 60 is operatively connected to the pneumatic actuator 92 of the pneumatically actuated flow control valves 90, 95 of the internal combustion engine. In the example embodiment illustrated in FIG. 2*a*, the primary fluid circuit 60 is operatively connected to a number of pneumatic actuators 92, each one being configured for controlling a corresponding pneumatically actuated flow control valve 90, 95 of the internal combustion engine. In this example, the number of pneumatic actuators 92 is twelve. Thus, the number of pneumatically actuated flow control valves 90, 95 is also twelve. However, the number of each one of the above-mentioned components of the system may vary depending on the type of engine and type of vehicle etc.

As illustrated in FIG. 2*a*, the pneumatic system 100 also comprises the mechanically driven compressor 70 configured to deliver a pneumatic pressure to the primary fluid circuit 60. In other words, the mechanically driven compressor 70 is in fluid communication with the primary fluid circuit. Further, the mechanically driven compressor 70 is arranged upstream of the primary fluid circuit, as depicted in the FIG. 2*a*, and as seen if the direction of the flow of the pressurized air is initiated from the compressor 70. It should be noted, however, that at least some portion of the compressed air typically re-circulates in the primary fluid circuit 60. Generally, the entire quantity of the compressed air re-circulates in the primary fluid circuit 60.

In the example embodiment described in relation to FIG. 2*a*, and also in relation to the other FIGS. 2*b* to 2*d*, and FIGS. 3 to 5, the compressor 70 includes a compressor cylinder 72. The compressor cylinder 72 comprises a reciprocating compressor piston 73, i.e. the reciprocating compressor piston is housed within the compressor cylinder 72 to operate in a reciprocating motion between an upper end, which is also commonly referred to as top dead center (TDC) and a lower end, which is also commonly referred to as bottom dead center (BDC). The cylinder 72 further comprises an inlet valve 74 at which gas, typically in the form of air at ambient gas pressure is controllably provided into the compression cylinder 72. The compression cylinder 72 also comprises an outlet valve 75 through which compressed air is controllably exhausted from the compression cylinder 72. The compressed air is delivered to the primary fluid circuit 60, as will be further described below.

Moreover, the pneumatic system 100 comprises a secondary fluid circuit 80 configured to define a secondary fluid passageway for transporting a compressed fluid medium. The compressed fluid medium in the secondary fluid circuit is generally denoted with reference 80*d*, as indicated in FIG. 2*c*. By way of example, the compressed fluid medium is compressed air. The secondary fluid circuit is denoted with a dotted line in FIG. 2*a*. The secondary fluid circuit 80 is in fluid communication with at least one cylinder 94 via an inlet passage 87 to receive the compressed fluid medium from the at least one cylinder. Optionally, although not strictly required, there is one or more valves disposed in the inlet passage 87. Thereby, the flow of the compressed fluid medium in the inlet passage 87 can be regulated as desired by the system. These types of valves may either be active controllable valves or passive controllable valves. Further, the secondary fluid circuit 80 is in fluid communication with an auxiliary pressurized system 81. Thus, the system 100 comprises the auxiliary pressurized system 81. The auxiliary pressurized system 81 is arranged in fluid communication with the secondary fluid circuit 80. Further, the auxiliary pressurized system 81 is arranged in fluid communication with the primary fluid circuit 60. To this end, the auxiliary pressurized system 81 defines an interface between the primary fluid circuit and the secondary fluid circuit and is configured to transfer energy from the secondary fluid circuit to the primary fluid circuit, as further described below.

As mentioned above, the auxiliary pressurized system 81 is operatively connected to the primary fluid circuit, typically via an outlet passage 89. In the system depicted in FIG. 2*a*, the auxiliary pressurized system 81 is operatively connected to the low-pressure side 60*b* the primary fluid circuit. In particular, the auxiliary pressurized system 81 is operatively connected to the compressor 70. The auxiliary pressurized system 81 is operatively connected to the compressor 70 via the outlet passage 89. The outlet passage 89 is part of the primary fluid circuit and configured to connect the auxiliary pressurized system with the low-pressure side 60*b* of the primary fluid circuit. In the example embodiment described in relation to FIG. 2*a*, the auxiliary pressurized system 81 is essentially operatively connected directly to the compressor 70 via the outlet passage 89. Therefore, the outlet passage 89 is in fluid communication with the compressor 70. In this manner, the auxiliary pressurized system 81 is configured to support the compressor 70 in pressurizing the air intended for being supplied in the primary fluid circuit 60. Alternatively, the auxiliary pressurized system 81 can be operatively connected to the return fluid passage 66 of the low pressure side 60*b*.

The auxiliary pressurized system 81 comprises a chamber 83 and at least one reciprocating member 82 operable in the chamber 83. Further, the auxiliary pressurized system is arranged in fluid communication with the secondary fluid circuit 80 and operatively connected to the primary fluid circuit such that the at least one reciprocating member 82 is capable of pressurizing the primary fluid circuit when the compressed fluid medium of the secondary fluid circuit acts on the at least one reciprocating member 82. By way of example, the reciprocating member 82 is capable of pressurizing at least one of the low-pressure side 60*b* and the high-pressure side 60*a* of the primary fluid circuit, as further described below.

As depicted in e.g. FIG. 2*a*, the secondary fluid circuit 80 is separated from the primary fluid circuit 60 by the reciprocating member 82 and the chamber 83. More specifically, the relative arrangement of the chamber and the reciprocating member forms a so called fluid-tight configuration between the primary fluid circuit and the secondary fluid circuit. Thus, there is no possibility for dirty compressed fluid medium in the secondary fluid circuit to escape to the primary fluid circuit.

As such, the increased pressure obtained by means of the movement of the reciprocating member in the chamber is provided via the secondary fluid circuit to the primary fluid circuit. In this manner, it becomes possible to reduce the required energy of the primary fluid circuit by reducing the engagement need of the compressor.

The auxiliary pressurized system 81 receives compressed air from the secondary fluid circuit 80, which is in fluid communication with at least one cylinder 94 via the inlet passage 87 to receive compressed air from the at least one cylinder. In this example embodiment, and as schematically illustrated in FIG. 2*a*, the at least one cylinder is a cylinder of the internal combustion engine 10. Further, the cylinder 94 is used as an air compressor during a braking vehicle event or a vehicle deceleration event. Hereby, surplus energy from the braking vehicle event or the vehicle deceleration event can be used for delivering valve opening force by using the surplus energy and delivering compressed air from one of the engine cylinders 94 to the auxiliary pressurized system 81.

The inlet passage 87 is thus in fluid communication with the cylinder 94. In addition the inlet 87 defines a passage for transporting compressed air from the cylinder 94 to the auxiliary pressurized system 81. That is, the inlet passage 87 defines a passage for transporting compressed air from the cylinder 94 to the auxiliary pressurized system 81 when the corresponding outlet valve 95 is open. In this manner, compressed air generated from the braking force during a braking event or deceleration event is permitted to be transported to the secondary fluid circuit 80. It is also to be noted that the inlet passage 87 can be operatively connected to a separate valve (not shown) of the cylinder 94. Hence, the inlet passage 87 may likewise define a passage for transporting compressed air from the cylinder 94 to the auxiliary pressurized system 81 when a cylinder valve operatively connected to the inlet passage is open.

As will be readily appreciated from the above configuration of the secondary fluid circuit, the secondary fluid circuit 80 also defines a fluid passage for transporting the compressed medium, i.e. compressed air or compressed gas, between the inlet passage 87 and the auxiliary pressurized system 81. The inlet passage 87 should thus be a fluid passage configured to transport a high pressure fluid medium.

Referring again to the auxiliary pressurized system 81 and FIG. 2*a*, the auxiliary pressurized system 81 is configured to pressurize the primary fluid circuit by moving the reciprocating member 82 between a first end position and a second end position in the chamber 83. Subsequently, the increased pressure generated in the system 81 acts on one of the primary fluid circuit 60 and the compressor 70 via the outlet passage 89, thus raising the pressure in the primary fluid circuit. In other words, the air compressed in the cylinder 94 is directed through the inlet passage 87 to the auxiliary pressurized system 81 and acts on the reciprocating member 82 that in turn acts on the compressed air in the primary fluid circuit, thus raising the pressure in the primary fluid circuit.

As such, compressed air generated in the cylinder 94 during engine braking can be delivered to the auxiliary pressurized system 81, such that the compressed air causes the reciprocating member 82 to move in the chamber 83 until the pressure is sufficiently increased to support the primary fluid circuit in delivering the valve opening force to the pneumatic actuator of the pneumatically actuated flow control valve 90, 95. Hereby, during engine braking, high pressure air is provided to the primary fluid circuit 60 via the auxiliary pressurized system 81 and the secondary fluid circuit 80.

In other words, by delivering compressed air from one of the engine cylinders 94 to the auxiliary pressurized system 81, it becomes possible to effect a movement of the reciprocating member so as to pressurize the air in the primary fluid circuit, thus raising the pressure in the primary fluid circuit. To this end, the energy obtained by means of the auxiliary pressurized system is transmitted from the secondary fluid circuit to the primary fluid circuit. An advantage is thus that an improved utilization of energy is provided.

The reciprocating member 82 of the auxiliary pressurized system 81 can be provided in several different designs and configurations. In the example described in relation to FIG. 2*a*, the reciprocating member is a reciprocating piston member. As the details of the reciprocating compressor comprising the reciprocating piston member is a well-known type of compressor, it will not be further described herein.

Optionally, the secondary fluid circuit 80 comprises an air cooler 50 configured to lower the temperature of the compressed air received from the cylinder 94 prior to entering the auxiliary pressurized system 81. A system including the air cooler is described in relation to the FIG. 3 below. It should be noted that the air cooler is only an option in the pneumatic system, and thus not strictly required in the system. The air cooler is disposed in the secondary fluid circuit between the cylinder 94 and the system 81.

Moreover, the secondary fluid circuit is typically connected to an air inlet 78 for receiving external fresh air. The air inlet 78 is typically operatively connected to the secondary fluid circuit 80 at a position between the cylinder 94 and the auxiliary pressurized system 81. If the system 100 includes the air cooler 50, the air inlet 78 is typically operatively connected to the secondary fluid circuit 80 at a position between the cylinder 94 and the air cooler 50.

The cylinder being operatively connected to the secondary fluid circuit, as mentioned above, may not necessarily be one of the cylinders of the internal combustion engine. Rather, in another configuration example (not shown), the at least one cylinder is a separate braking compressor cylinder operatively connected to the air inlet 78. For example, the cylinder can be the vehicle compressor utilized for the braking system.

Typically, although not strictly required, the system comprises a control unit 96, illustrated in FIG. 1, which is configured to operate the auxiliary pressurized system 81 upon the braking vehicle event or the vehicle deceleration event.

Regarding the pneumatic actuator 92 and the pneumatically actuated flow control valves 90, 95 of the engine or the engine system, it should be noted that these components can be provided in several different configurations depending on installation and type of engine or engine system. Typically, the flow control valves 90, 95 are adapted to regulate the flow of the fluid medium passing through the flow control valve. The fluid medium may be air, compressed air, burnt gases, exhaust gases etc. depending whether the flow control valve is an inlet flow control valve or an outlet flow control valve. As mentioned above, the flow control valve 90, 95 comprises the actuator 92, which is typically operatively connected to a valve member of the flow control valve. The valve member can be a lift type valve member. By way of example, the lift type member can be a conventional poppet valve or the like, as shown in FIG. 2*a*. However, the valve member may likewise be provided as a rotational type valve member, a slide valve member, a seat valve member of the like. The actuator of the valve is configured to operate the valve (the valve member) by pneumatic pressure. As such, the valve 90, 95 in this example is a pressure activated valve member. In this example, each one of the actuated flow control valves 90, 95 comprises a corresponding pneumatic actuator 92 operatively connected to a corresponding valve member. The actuator 92 is in fluid communication with the pressurized air in the primary fluid circuit 60 via the passage 63. In this manner, the pneumatic valve actuation utilizes compressed air to control the valve opening of the valve (or the valve member), i.e. to operate the valve between an open fluid medium state and a closed fluid medium state. The valve 90, 95 is typically adapted to close the valve opening upon a signal from the actuator 92, which is generally generated by the control unit 96, or any other control unit in the vehicle. Moreover, the actuated flow control valve 90, 95 (via the actuator) is configured to control a valve parameter relating to any one of flow area, flow time, valve lift or a combination thereof. By way of example, the actuator is typically configured to control the opening and closure of the valve member at a given point in time. Therefore, the actuator is typically configured to control the opening and closure of the valve member at a given point in time by receiving a signal from the control unit or the like.

Accordingly, FIG. 2*a* illustrates a pneumatic system 100 for supplying compressed air to the internal combustion engine 10. The system comprises the primary fluid circuit 60 configured to define the fluid passageway for circulating compressed air there through and the mechanically driven compressor 70 configured to deliver a pneumatic pressure to the primary fluid circuit. The primary fluid circuit is further operatively connectable to the pneumatic actuator 92 of the pneumatically actuated flow control valve 90, 95, thereby capable of delivering a valve opening force. Moreover, the system 100 comprises the secondary fluid circuit 80 operatively connected to at least the compressor 70 via the outlet 89, and further in fluid communication with at least one cylinder 94 via the inlet 87 to receive compressed air from the cylinder. Also, the system comprises the auxiliary pressurized system 81 configured to pressurize the primary fluid circuit. The auxiliary pressurized system comprises the chamber 83 and the reciprocating member 82 operable in the chamber 83 such that the at least one reciprocating member is capable of pressurizing the low-pressure side of the primary fluid circuit when the compressed fluid medium of the secondary fluid circuit acts on the at least one reciprocating member.

As mentioned above, the primary fluid circuit may have one or more valves, or a valve assembly, in order to regulate the transfer of the compressible fluid medium in the primary fluid circuit. By way of example, the primary fluid circuit may comprise a first controllable valve assembly arranged in the low-pressure side 60*b* of the primary fluid circuit and configured to regulate the flow of compressible fluid medium between the low-pressure side 60*b* and the auxiliary pressurized system 81. By means of arrangement of the first controllable valve assembly, the direction of the flow of the compressible fluid medium in the primary fluid direction can be controlled between a first state, in which compressible fluid medium is transferred from the primary fluid circuit to the auxiliary pressurized system and a second state, in which compressed fluid medium is transferred from the auxiliary pressurized system to the primary fluid circuit. It should be noted that the transfer of compressible fluid medium from the primary fluid circuit to the auxiliary pressurized system and the transfer of compressed fluid medium from the auxiliary pressurized system to the primary fluid circuit can occur intermittently in one and the same passage of the primary fluid circuit or in two separate passages. One example of the transferring fluid medium in two separate passages between the primary fluid circuit and the auxiliary pressurized system is further described below in relation to FIG. 2*c*.

Analogously, the secondary fluid circuit may have a corresponding valve, or valve assembly, for regulating the transfer of the compressed fluid medium in the secondary fluid circuit. The arrangement of the valves, or valve assemblies, in the primary fluid circuit and the secondary fluid circuit are now further described in relation to the example embodiment illustrated in FIG. 2*c*. FIG. 2*c* is a schematic illustration of additional parts of the example embodiment of the system in FIG. 2*a* according to the present invention. It should thus be noted that the system 100 in FIG. 2*c* incorporates the features and examples described in relation to the example embodiment described in relation to FIG. 2*a*.

In the example embodiment in FIG. 2*c*, the primary fluid circuit 60 further comprises another return passage 60*c* extending to the auxiliary pressurized system 81 for transporting the compressible fluid medium 60*d* to the auxiliary pressurized system 81. As mentioned above, the primary fluid circuit 60 here also comprises the first controllable valve assembly 34 for controlling the flow direction and transfer of the compressible fluid medium in the primary fluid circuit 60. The first controllable valve assembly 34 is arranged in the low-pressure side 60*b* of the primary fluid circuit. Thus, the auxiliary pressurized system 81 is connected to the compressor 70 via the outlet passage 89 and the valve assembly 34.

Also, as illustrated in FIG. 2*c*, the return passage 60*c* is connected to the first controllable valve assembly 34. In other words, the return passage 60*c* provides a connection between the first controllable valve assembly 34 and the auxiliary pressurized system 81. The first controllable valve assembly 34 is arranged to regulate the transfer of compressible fluid medium from the low-pressure side 60*b* to the auxiliary pressurized system 81. The first controllable valve assembly 34 is here also arranged to regulate the transfer of compressible fluid medium from the low-pressure side 60*b* to the compressor 70. As mentioned above in relation to FIG. 2*a*, the compressible fluid medium 60*d* in the primary fluid circuit 60 is compressed air, which will be further compressed in the auxiliary pressurized system. Thus, in operation, the first controllable valve assembly 34 is initially controlled to permit a transfer of compressible fluid medium 60*d* to the return passage 60*c* from the passage 66 of the low-pressure side 60*b* of the primary fluid circuit. The compressible fluid medium is directed to the auxiliary pressurized system 81 via the return passage 60*c*. Thereafter, the return passage 60*c* is closed by operating the valve assembly 34 and the compressible fluid medium is pressurized by means of the auxiliary pressurized system, as mentioned above. Finally, the compressed fluid medium is delivered to the compressor 70 via the outlet passage 89 and through the valve assembly 34, as indicated by the arrows in FIGS. 2*a* and 2*c*. In this example, the valve assembly 34 is a flow control valve configured to regulate the flow of the compressed fluid medium. Regarding the passage 66, it is also to be noted that the return fluid passage 66 here connects to the compressor 70 via the first controllable valve assembly 34. As indicated in e.g. FIG. 2*c*, the compressed fluid medium 60*d* is also transferred in the outlet passage 89 from the auxiliary pressurized system 81 to the first controllable valve assembly 34. Accordingly, as illustrated in e.g. FIG. 2*c*, the first controllable valve assembly 34 provides for a regulation of the flow direction of the compressed fluid medium 60*d* between any one of the return passage 66, the return passage 60*c*, the outlet passage 89 and the compressor 70.

Turning now to the auxiliary pressurized system 81, while still referring to FIG. 2*c*, the auxiliary pressurized system is arranged in fluid communication with the secondary fluid circuit 80 and in fluid communication with the primary fluid circuit. As depicted in FIG. 2*c*, the chamber 83 of the system 81 is generally also defined by a first part 84*a* and a second part 84*b*. The first part and the second part are arranged on opposite sides of the reciprocating member 82. The first part 84*a* defines an inner volume for receiving and partly containing the compressible fluid medium 60*d*. The second part 84*b* defines an inner volume for receiving and partly containing the compressed fluid medium 80*d*.

Further, as illustrated in e.g. FIG. 2*c*, the return passage 60*c* of the primary fluid circuit 60 is connected to the first part 84*a* of the chamber 83. In other words, the first part 84*a* is arranged in fluid communication with the primary fluid circuit both via the outlet passage 89 and the return passage 60*c*. As the return passage 60*c* is connected to the first controllable valve assembly 34, the first controllable valve assembly is arranged to regulate the transfer of compressible fluid medium from the return passage 60*c* to the first part 84*a* of the chamber of the auxiliary pressurized system.

Turning now to the secondary fluid circuit 81, it is also possible to arrange a valve assembly for regulating the flow of the compressed fluid medium 80*d*. As illustrated in FIG. 2*c*, the secondary fluid circuit here 80 comprises a second controllable valve assembly 44 arranged to regulate the transfer of compressed fluid medium 80*d* in-between the auxiliary pressurized system 81 and the secondary fluid circuit 80. As depicted in FIG. 2*c*, the second controllable valve assembly 44 is arranged to regulate the flow of compressed fluid medium 80*d* from the inlet passage 87 to the auxiliary pressurized system 81 and also arranged to regulate a discharge of the compressed fluid medium 80*d* from the auxiliary pressurized system to the air outlet 78. The air outlet 78 may also work as an air inlet depending on operation of the system and vehicle. In other words, the secondary fluid circuit 80 generally comprises a fluid passage that is capable of transferring compressed fluid medium 80*d* in both directions. Thus, in operation, the second controllable valve assembly 44 is initially controlled to permit a transfer of compressed fluid medium 80*d* from the inlet passage 87 to the auxiliary pressurized system 81. Thereafter, the valve assembly 44 is closed and the compressed fluid medium 80*d* is used to pressurize compressible fluid medium 60*d* in the primary fluid circuit by means of the auxiliary pressurized system. Finally, the valve assembly 44 is opened and the compressed fluid medium 80*d* can discharge from the secondary fluid circuit via the outlet 78, such that the fluid passageway of the secondary fluid circuit provides a discharge fluid medium passage 80*c*, as shown in FIG. 2*c*. By way of example, the second controllable valve assembly 44 is here a flow control valve, as disclosed above.

Figure 2B:
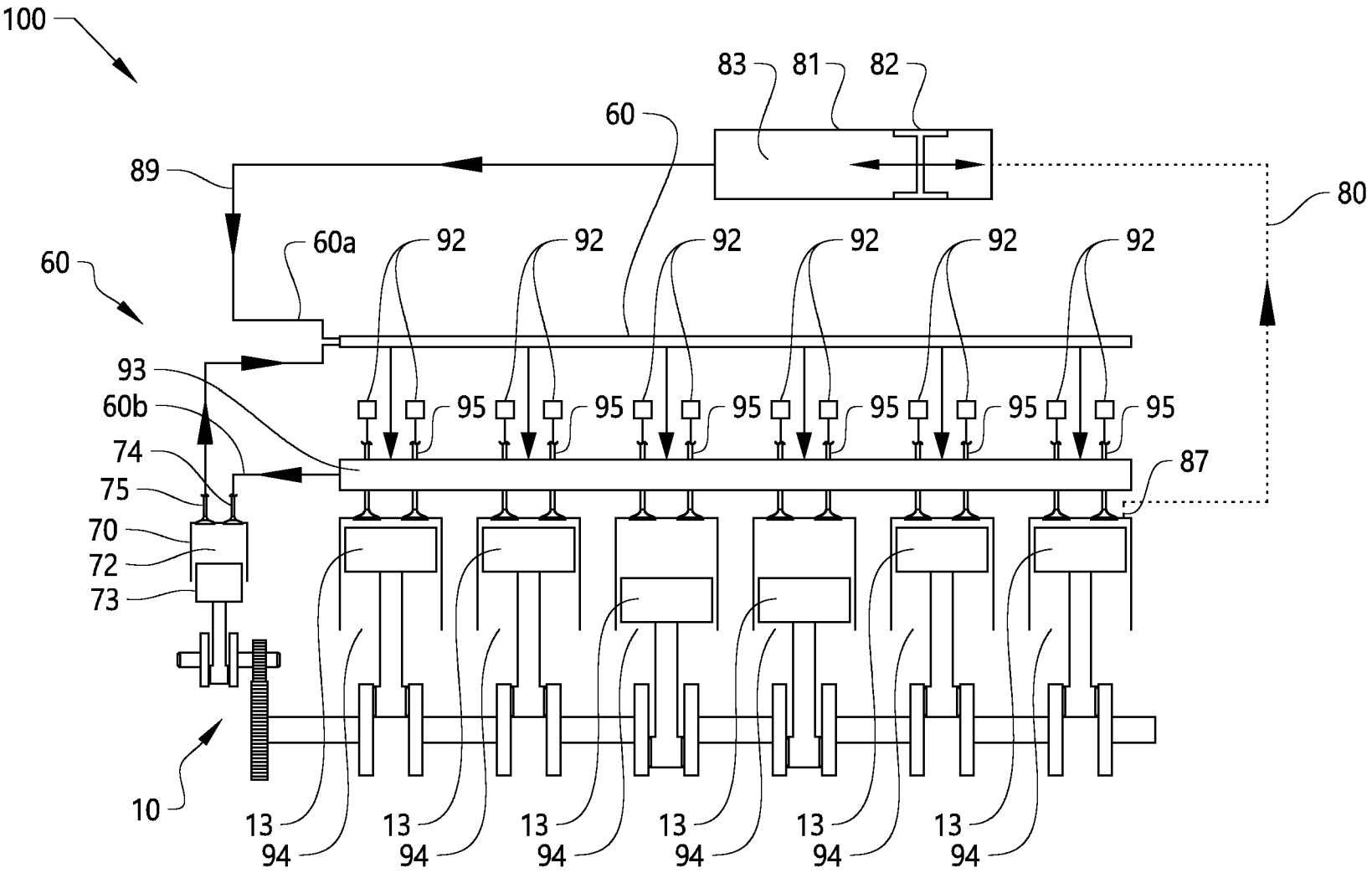
FIG. 2*b* is a schematic illustration of another example embodiment of a system for operating a valve of an internal combustion engine of the vehicle according to the present invention.
Figure 2C:
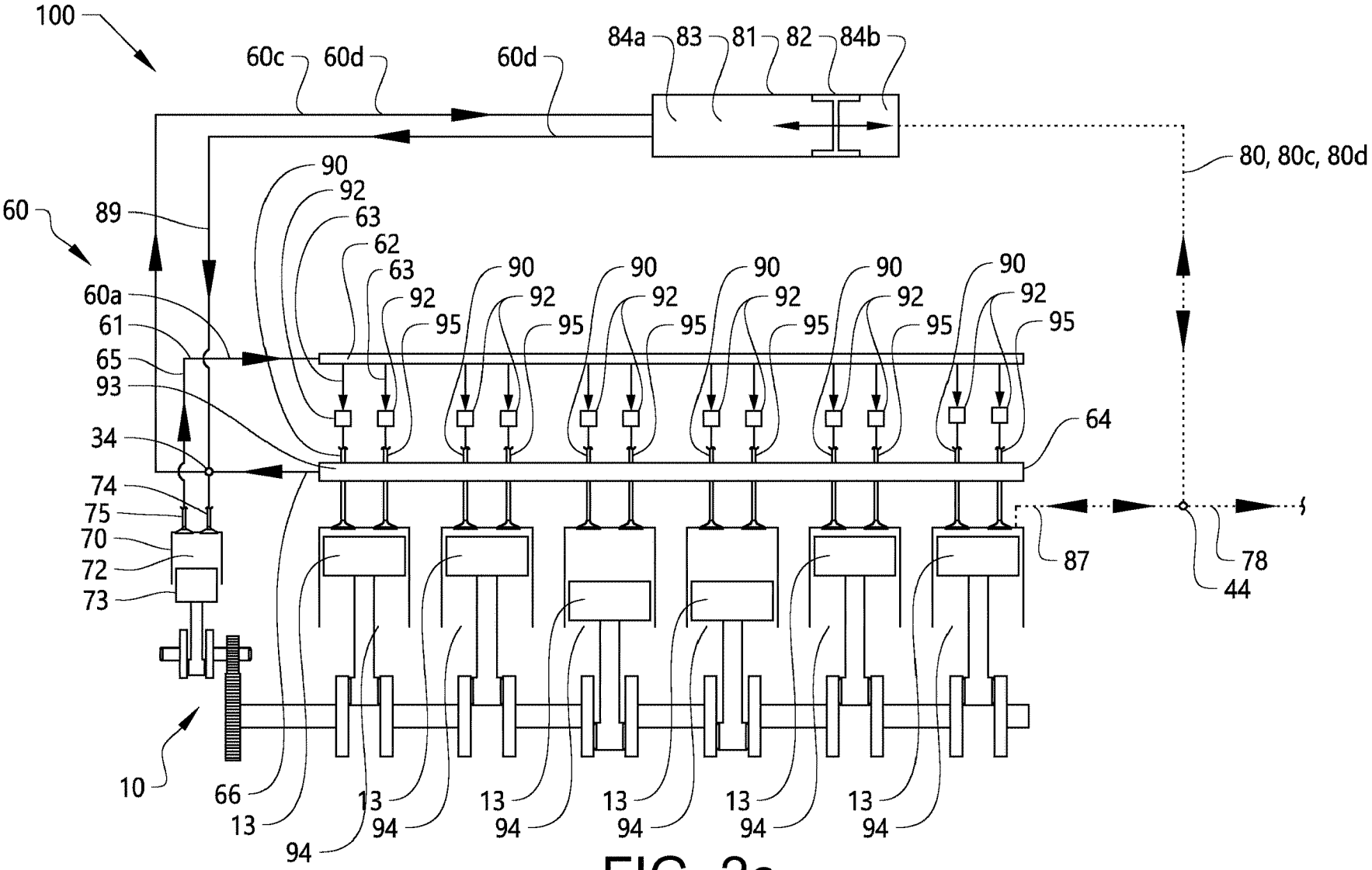
FIG. 2*c* is a schematic illustration of additional parts of the example embodiment of the system in FIG. 2*a* according to the present invention.

FIG. 2*b* is a schematic illustration of another example embodiment of a pneumatic system for operating a valve of an internal combustion engine of the vehicle according to the present invention. The difference between the embodiment depicted in FIG. 2*b* and the embodiment depicted in FIG. 2*a* is that the system in FIG. 2*b* comprises an auxiliary pressurized system 81 operatively connected to the high-pressure side 60*a* of the primary fluid circuit. Thus, the auxiliary pressurized system 81 is operatively connected to the primary fluid circuit 60 via the outlet passage 89. Therefore, the auxiliary pressurized system is configured to pressurize the primary fluid circuit (high-pressure side) rather than the compressor (low-pressure side) via the outlet passage 89.

Besides this difference, any one of the other features, configurations, components, effects, functions and/or advantages of the example embodiment of the system 100 described in relation to FIGS. 2*a* and 2*c* may likewise be incorporated into the system 100 as described in relation to FIG. 2*b*, at least as long as there are no functional contradictions between the systems.

Thus, in another example embodiment, although not illustrated, there is provided a pneumatic system 100, in which the auxiliary pressurized system 81 is operatively connected to the primary fluid circuit 60 and the compressor 70 via the outlet passage 89. In this configuration of the system, the auxiliary pressurized system is configured to pressurize the primary fluid circuit and the compressor via the outlet passage 89. Also, this example may incorporate any one of the other features, configurations, components, effects, functions and/or advantages of the example embodiment of the system 100 described in relation to FIGS. 2*a* and 2*b*.

Figure 2D:
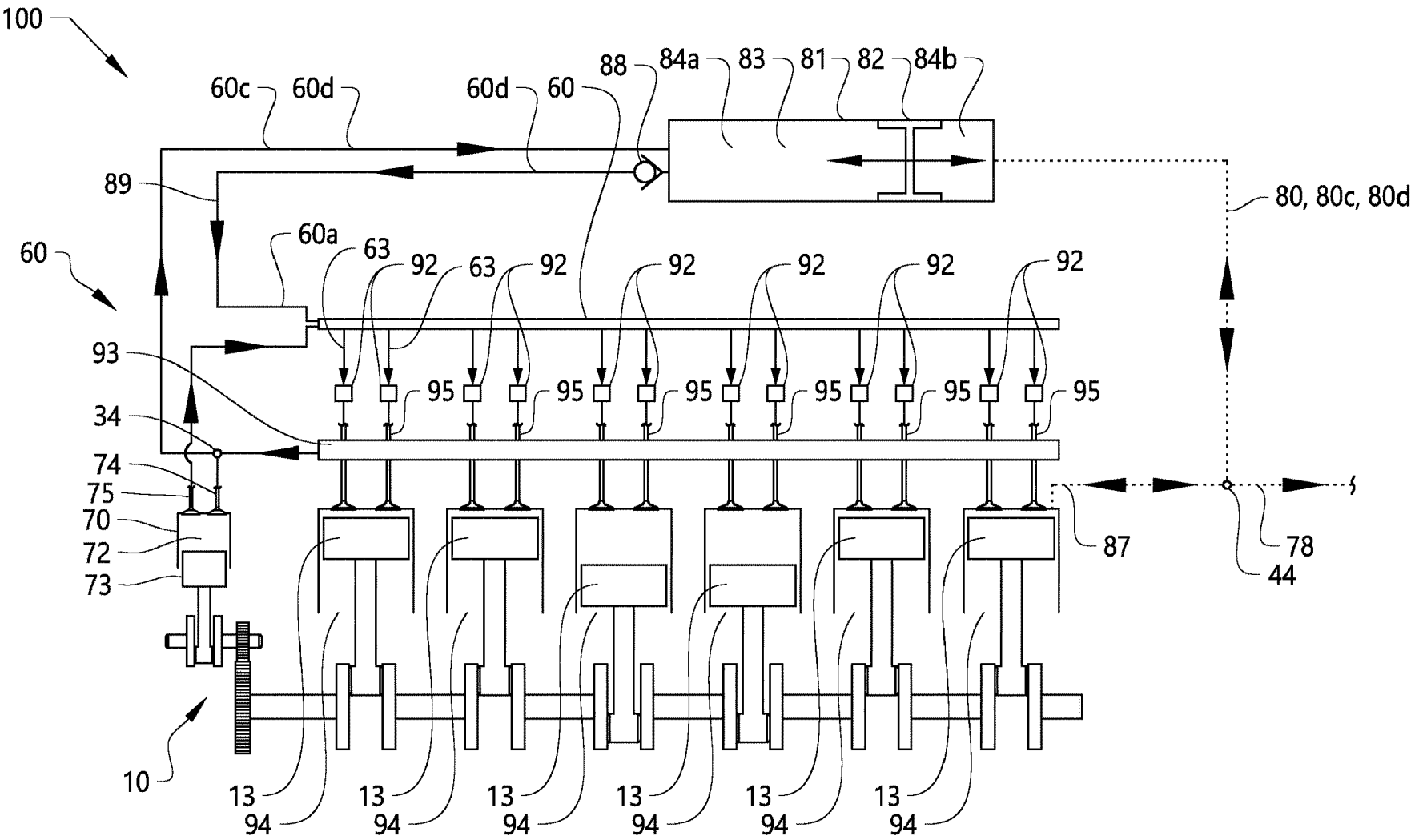
FIG. 2*d* is a schematic illustration of additional parts of the example embodiment of the system in FIG. 2*b* according to the present invention.

FIG. 2*d* is a schematic illustration of additional parts of the example embodiment of the system in FIG. 2*b* according to the present invention. Besides the features described in relation to FIG. 2*b*, the example embodiment in FIG. 2*d* also comprises the return passage 60*c* and the first controllable valve assembly 34 as described in relation to FIG. 2*c*. In addition, the example embodiment in FIG. 2*d* comprises the secondary fluid circuit and the second controllable valve assembly 44, as described in relation to FIG. 2*c*. As depicted in FIG. 2*d*, the outlet passage 89 here comprises a second valve 88 in the form of a check valve 88. In this example, the second valve 88 is disposed between the auxiliary pressurized system 81 and the high-pressure side 60*a*. In this manner, the second valve 88 is arranged to facilitate a transfer of compressible fluid medium 60*d* from the return passage 60*c* to the auxiliary pressurized system 81. That is, the second valve 88 is arranged to prevent compressed fluid medium 60*d* of higher pressure in the high-pressure side 60*a* to revert to the auxiliary pressurized system 81.

Figure 3:
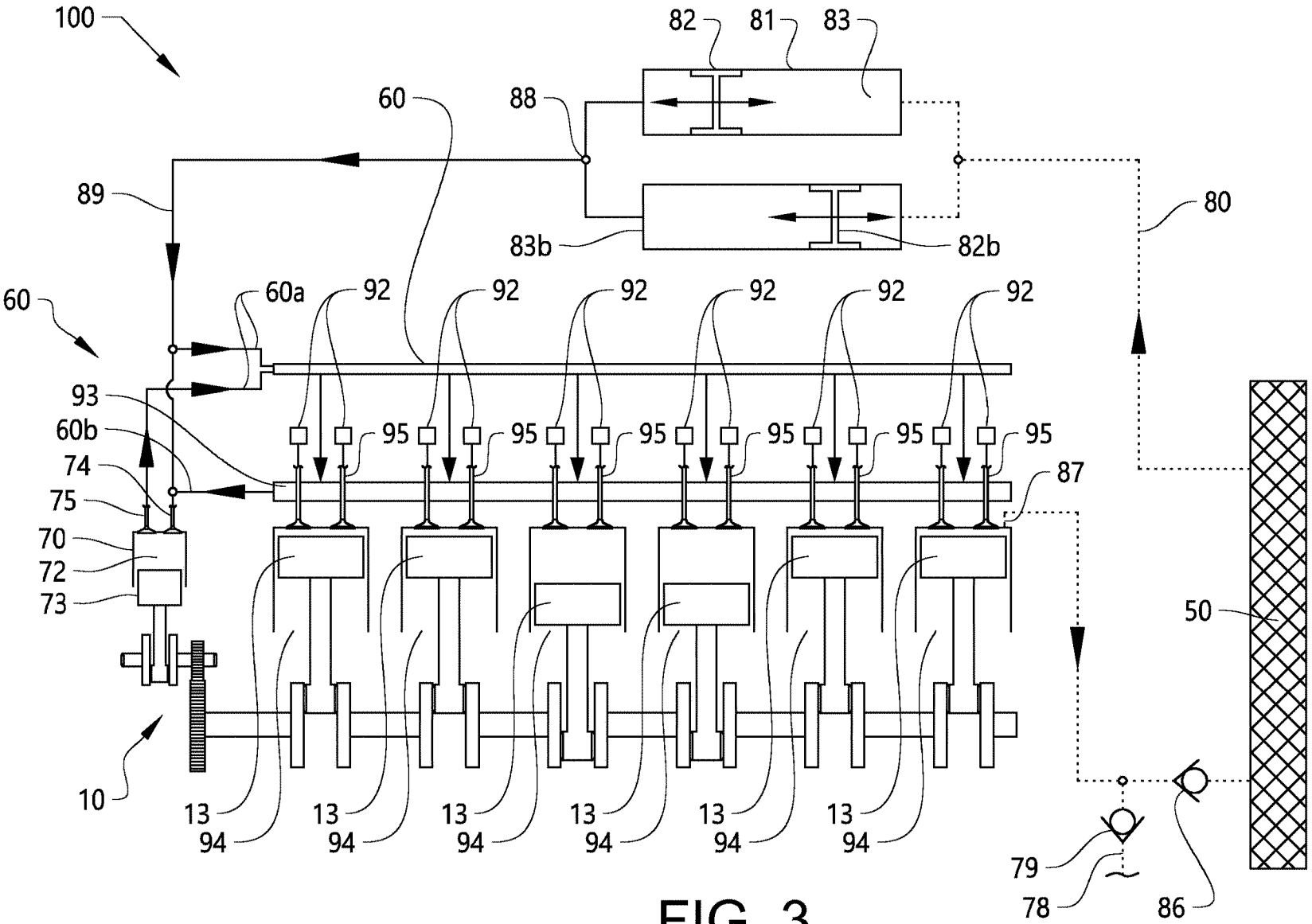
FIG. 3 is a schematic illustration of yet another example embodiment of a system for operating a valve of an internal combustion engine of the vehicle according to the present invention.

FIG. 3 is a schematic illustration of yet another example embodiment of a pneumatic system for operating a valve of an internal combustion engine of the vehicle according to the present invention. The difference between the embodiment depicted in FIG. 3 and the embodiment depicted in FIG. 2*a* is that the embodiment in FIG. 3 has an auxiliary pressurized system 81 comprising an additional chamber 83*b* an additional reciprocating member 82*b* operable in the additional chamber 83*b*. The additional reciprocating member 82*b* is operable in the additional chamber 83*b* to further pressurize the compressed air supplied via the inlet. Thus, auxiliary pressurized system 81 is configured to pressurize at least one of the primary fluid circuit 60 and the compressor 70 via the outlet passage 89.

The additional reciprocating member 82*b* is capable of pressurizing the primary fluid circuit when the compressed air acts on the additional reciprocating member 82*b*. Accordingly, the additional reciprocating member 82*b* should be capable of pressurizing at least one of the low-pressure side 60*b* and the high-pressure side 60*a* of the primary fluid circuit when the compressed air acts on the additional reciprocating member 82*b*.

As depicted in FIG. 3, the chamber 83 and the additional chamber 83*b* are arranged in parallel to each other so as to pressurize the outlet passage 89 in an alternated manner.

Further, the system 100 comprises a second valve 88 disposed downstream of the auxiliary pressurized system 81 and configured to control the pressure from the auxiliary pressurized system 81 and optionally between the chambers 83, 83*b*. The second valve 88 is in this example disposed in the outlet passage 89.

It is to be noted that the example embodiment described in relation to FIG. 2*a* may also include the second valve (although not shown). In this manner, it becomes possible to close the communication between the auxiliary pressurized system and the primary fluid circuit. Hence, in this example embodiment, the second valve is configured to control the pressure provided from the auxiliary pressurized system 81, only.

By providing the auxiliary pressurized system with the additional reciprocating member 82*b* being operable in the additional chamber 83*b*, it becomes possible to increase the efficiency of the auxiliary pressurized system as the pressure can be provided with less interruption.

In addition, in the example embodiment in FIG. 3, the secondary fluid circuit also includes the air cooler 50, as mentioned above. The air cooler 50 is configured to lower the temperature of the compressed air received from the cylinder 94 prior to entering the auxiliary pressurized system 81. The air cooler is disposed in the secondary fluid circuit between the cylinder 94 and the system 81. Moreover, the secondary fluid circuit is typically connected to the air inlet 78 for receiving external fresh air. The air inlet 78 is typically operatively connected to the secondary fluid circuit 60 at a position between the cylinder 94 and the auxiliary pressurized system 81. If the system 100 includes the air cooler 50, the air inlet 78 is typically operatively connected to the secondary fluid circuit 80 at a position between the cylinder 94 and the air cooler 50.

Optionally, although strictly not required, the secondary fluid circuit 80 in the example embodiment in FIG. 3 comprises a first intake valve 86 disposed in the inlet passage 87 and upstream of the auxiliary pressurized system 81. The first intake valve 86 is configured to prevent discharge of compressed air from the secondary fluid circuit when the cylinder is not operated as a compressor. Hence, the compressed air is only permitted to flow from the cylinder 94 to the auxiliary pressurized system 81.

In the example when the secondary fluid circuit is connected to the air inlet 78 for receiving external fresh air, the inlet passage may comprise an air inlet valve 79 configured to prevent discharge of compressed air through the air inlet 78, which is illustrated in FIG. 3. The air inlet 78 is typically operatively connected to the secondary fluid circuit 80 at a position between the cylinder 94 and the auxiliary pressurized system 81.

Besides this differences, any one of the other features, configurations, components, effects, functions and/or advantages of the example embodiment of the system 100 described in relation to FIGS. 2*a* to 2*d* may likewise be incorporated into the system 100 as described in relation to FIG. 3, at least as long as there are no functional contradictions between the systems.

Figure 5:
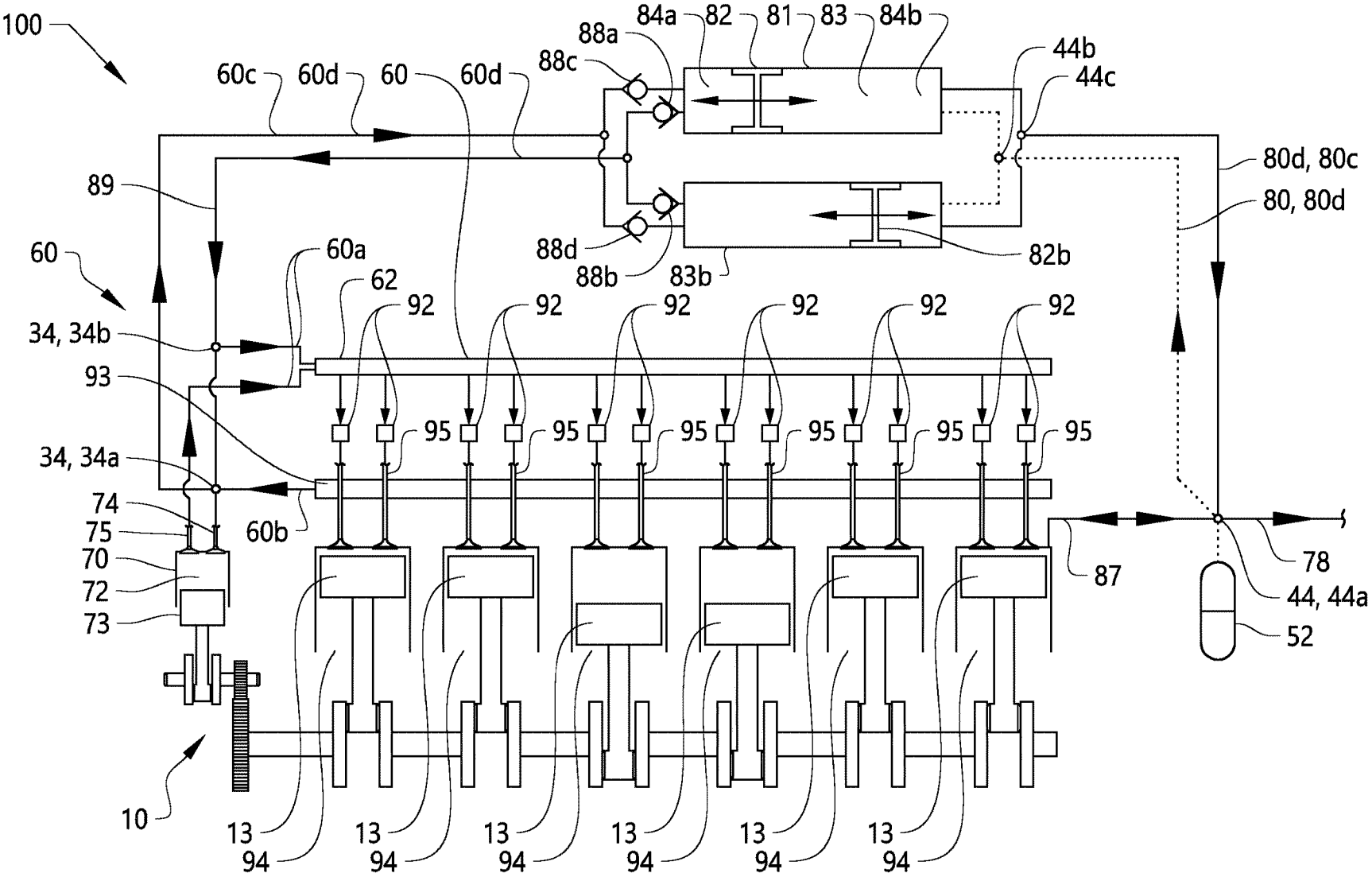
FIG. 5 is a schematic illustration of yet another example embodiment of a system for operating a valve of an internal combustion engine of the vehicle according to the present invention.

FIG. 5 is a schematic illustration of yet another example embodiment of a pneumatic system for operating a valve of an internal combustion engine of the vehicle according to the present invention. FIG. 5 generally incorporates the features of the example embodiment described in relation to FIG. 3 besides the following features.

The difference between the embodiment depicted in FIG. 5 and the embodiment depicted in FIG. 3 is that the embodiment in FIG. 5 has a secondary fluid circuit 80 comprising a fluid medium storage device 52. Hence, as illustrated in FIG. 5, the secondary fluid circuit 80 here comprises the fluid medium storage device 52 disposed between the inlet passage 87 and the auxiliary pressurized system 81. The fluid medium storage device is arranged to accommodate a portion of the compressed fluid medium 80*d*.

Moreover, the example embodiment in FIG. 5 comprises the return passage 60*c* and the first controllable valve assembly 34 as described in relation to FIG. 2*c*.

In addition, the example embodiment in FIG. 5 comprises the secondary fluid circuit and the second controllable valve assembly 44, as described in relation to FIG. 2*c*. Thus, the second controllable valve assembly 44 may here replace the first intake valve 86 in FIG. 3 and the air inlet valve 79 in FIG. 3. As depicted in FIG. 5, the second controllable valve assembly 44 is connected to the fluid medium storage device 52. Thus, the second controllable valve assembly 44 here comprises a valve 44*a* for regulating the flow of compressed fluid medium from the fluid medium storage device 52 to the auxiliary pressurized system 81.

Further, as depicted in FIG. 5, the secondary fluid circuit 80 has a discharge fluid medium passage 80*c* in fluid communication with the second part 84*b* of the chamber of the auxiliary pressurized system. The discharge fluid medium passage is arranged to permit the compressed fluid medium 80*d* to discharge from the auxiliary pressurized system in a separate passage in the secondary fluid circuit. Typically, the second controllable valve assembly 44 is here configured to regulate the flow of compressed fluid medium in the discharge fluid medium passage. Hence, the discharge fluid medium passage 80*c* is in fluid communication with the second controllable valve assembly 44. The valve assembly 44 is thus further arranged to permit the compressed fluid medium 80*d* to discharge from the auxiliary pressurized system.

As illustrated in FIG. 5, the discharge fluid medium passage here comprises an additional valve 44*c*. The valve 44*c* is arranged upstream of the auxiliary pressurized system 81. The valve 44*c* is typically a part of the second controllable valve assembly 44. However, in this example, the valve 44*c* is arranged separate in the secondary fluid circuit, and also separate from the valve 44*a* of the valve assembly 44. The valve 44*c* is disposed downstream the valve 44*a* and the fluid medium storage device 52. In this manner, the valve 44*c* is configured to control the discharge of the compressed fluid medium from the chambers 83, 83*b*.

Analogously, as depicted in FIG. 5, a similar valve 44*b* is arranged in the secondary fluid circuit 80 to control the transfer of compressed fluid medium 80*d* to, and between, the chambers 83, 83*b*. The valve 44*b* is arranged upstream of the auxiliary pressurized system 81. The valve 44*b* is here also a part of the second controllable valve assembly 44. The valve 44*b* is arranged separate in the secondary fluid circuit, and also separate from the valve 44*a* and valve 44*c* of the valve assembly 44. Further, the valve 44*b* is disposed downstream the valve 44*a* and the fluid medium storage device 52.

In a similar vein, the second valve 88 disposed downstream of the auxiliary pressurized system 81, i.e. in the primary fluid circuit, as described e.g. in relation to FIG. 2*d* and FIG. 3, may comprise a number of sub-valves 88*a*, 88*b*, 88*c* and 88*d*. The sub-valves are distributed and configured to control the pressure from the auxiliary pressurized system 81 and between the chambers 83, 83*b*. The valves 88*a*, 88*b* are here disposed in the outlet passage 89, while the valves 88*c* and 88*d* are disposed in the return passage 60*c*.

Optionally, the high-pressure side 60*a* of the primary fluid circuit comprises a sub-valve 34*b* arranged upstream of the fluid compartment 62. The sub-valve 34*b* is here a part of the first controllable valve assembly 34. Hence, the first controllable valve assembly 34 here comprises a valve assembly with a sub-valve 34*a* and the sub-valve 34*b*. The sub-valve 34*b* is arranged to permit a regulation of the transfer of compressed fluid medium 60*d* between the fluid compartment 62 and the compressor 70. In this manner, it becomes possible to pre-fill the fluid compartment 62 and the compressor 70 with compressed fluid medium 60*d*. The sub-valve 34*a* has the same function as the valve assembly 34 described above in relation to FIGS. 2*c* and 2*d*.

It may also be noted that the embodiment depicted in 5 is provided without the optional air cooler 50. However, the air cooler may likewise also be arranged in the embodiment described in relation to FIG. 5.

Besides the above differences between the embodiment in FIG. 5 and FIG. 3, any one of the other features, configurations, components, effects, functions and/or advantages of the example embodiment of the system 100 described in relation to FIGS. 2*a*-2*d* and FIG. 3 may likewise be incorporated into the system 100 as described in relation to FIG. 5, at least as long as there are no functional contradictions between the systems.

Also, it should be noted that any one of the features, configurations, components, effects, functions and/or advantages described in relation to the example embodiment in FIG. 5 may likewise be incorporated into the system 100 as described in relation to any one of the FIGS. 2*a*-2*d* and FIG. 3. Actually, any one of the features, configurations, components, effects, functions and/or advantages described in relation to any one of the example embodiments may likewise be incorporated into the system as described in relation to any one of the other embodiments, as long as there are no functional contradictions between the embodiments.

Reference is now made to FIG. 4, which is a flow chart illustrating an example embodiment of a method for controlling an internal combustion engine system according to the present invention. In particular, the method is configured for controlling a pneumatic system 100 as described in relation to any one of the example embodiments depicted in FIGS. 2*a*, 2*b* and 3. For ease of reference, the method is described with reference to FIG. 4 in conjunction with FIG. 2*a*. In other words, there is provided a method 200 for operating a valve of an internal combustion engine 10 by means of the pneumatic system 100 according any one of the example embodiments described above. The method comprises the steps of:

operating 210 the at least one cylinder as a fluid medium compressor during vehicle braking or vehicle deceleration;

supplying 220 compressed fluid medium from the at least one cylinder to the auxiliary pressurized system 81 via the inlet passage 87;

operating 230 the auxiliary pressurized system 81 by means of the compressed fluid medium supplied to the auxiliary pressurized system 81; and pressurizing 240 the primary fluid circuit via the fluid communication between the auxiliary pressurized system and the primary fluid circuit.

The steps of the method described above are typically executed by a computer program comprising program code means for performing the method when the program is run on a computer. In addition, there is provided a computer readable medium carrying a computer program comprising program means for performing the steps of method as described above in relation to FIG. 4, when the program means is run on a computer.

The method described above in relation to FIG. 4 may include any other feature, effect or function as described in relation to the example embodiments above in relation to FIGS. 1, 2*a*-2*d*, 3 and 5.

As mentioned above, there is thus also provided the internal combustion engine system 10 comprising the pneumatic system 100 according to any one of the example embodiments above, and which are described in relation to FIGS. 2*a*, 2*b* and 3. The internal combustion engine system 10 includes at least one cylinder operatively connected to the inlet passage 87 of the secondary fluid circuit 80 of the system 100. The at least one cylinder can be any one of the cylinder of the engine, the separate braking compressor cylinder operatively connected to the inlet air passage 87, or the vehicle braking compressor operatively connected to the inlet air passage 87.

Also, the example embodiments of the invention includes the vehicle 1 having a pneumatic system 100 according to any one of the example embodiments above, and which are described in relation to FIGS. 2*a* to 2*d* and FIGS. 3, 4 and 5, or an internal combustion engine system 10 according to any one of the example embodiments above, and which are described in relation to FIGS. 2*a* to 2*d* and FIGS. 3, 4 and 5.

It is to be understood that the present invention is not limited to the embodiments described above and illustrated in the drawings; rather, the skilled person will recognize that many changes and modifications may be made within the scope of the appended claims. As an example, although the above example embodiments of the invention have been described in relation to one type of internal combustion engine system, it should be readily understood that other compression-combustion arrangements are conceivable. For example, two compression cylinders and another number of combustion cylinders may also equally as well be used. Furthermore, although the above example embodiments of the invention have been described in relation to pneumatic system for pressurizing compressed air in the primary fluid circuit, it should be readily understood that the primary fluid circuit also can be a hydraulic primary fluid circuit containing a liquid fluid such as oil. Thus the invention also relates to system for pressurizing a fluid medium such as a liquid in the primary fluid circuit.

The invention claimed is:

1. A valve operating system of an internal combustion engine, said valve operating system comprising:

a primary fluid circuit defining a primary fluid passageway configured to circulate a first volume of compressible fluid medium to a valve actuator of at least one gas exchange valve of said internal combustion engine, the valve actuator configured to deliver a valve opening force to said at least one gas exchange valve;

a secondary fluid circuit defining a secondary fluid passageway configured to transport a second volume of compressible fluid medium, the secondary fluid circuit including an inlet passage configured to receive the second volume from a cylinder; and an auxiliary pressurized system configured to transfer energy from the secondary fluid circuit to the primary fluid circuit while maintaining the first volume separate from the second volume, said auxiliary pressurized system comprising a chamber and at least one reciprocating member configured to reciprocate within said chamber said primary fluid circuit is pressurized when a pressure in the secondary fluid circuit moves said at least one reciprocating member so as to compress the first volume.

2. The valve operating system according to claim 1, wherein the at least one reciprocating member separates the primary fluid circuit from the secondary fluid circuit such that the chamber forms a fluid-tight configuration between the primary fluid circuit and the secondary fluid circuit.

3. The valve operating system according to claim 1, wherein the primary fluid circuit comprises a first controllable valve assembly configured to regulate a flow of the first volume within the primary fluid circuit.

4. The valve operating system according to claim 3, wherein the primary fluid circuit further comprises a return passage configured to transport the first volume to the chamber, and wherein the first controllable valve assembly is configured to regulate the flow of the first volume from the return passage to the chamber.

5. The valve operating system according to claim 1, wherein the secondary fluid circuit further comprises a first intake valve disposed in said inlet passage upstream of from the auxiliary pressurized system, said first intake valve configured to prevent a discharge of said second volume from the secondary fluid circuit.

6. The valve operating system according to claim 1, wherein said auxiliary pressurized system further comprises an additional chamber and an additional reciprocating member configured to reciprocate within said additional chamber such that said primary fluid circuit is further pressurized when said second volume acts on said additional reciprocating member so as to further compress said first volume, wherein said chamber and said additional chamber are arranged in parallel to each other.

7. The valve operating system according to claim 1, wherein the primary fluid circuit comprises a second valve configured to control a pressure downstream from the auxiliary pressurized system.

8. The valve operating system according to claim 1, wherein the at least one reciprocating member is one of a diaphragm membrane or a reciprocating piston.

9. The valve operating system according to claim 1, wherein the secondary fluid circuit comprises a second controllable valve assembly configured to regulate a flow of the second volume from the secondary fluid circuit to the auxiliary pressurized system.

10. The valve operating system according to claim 9, wherein the secondary fluid circuit further comprises a discharge fluid medium passage in fluid communication with the chamber, and wherein the second controllable valve assembly is configured to regulate the flow of the second volume in the discharge fluid medium passage.

11. The valve operating system according to claim 1, wherein the secondary fluid circuit comprises a fluid medium storage device disposed between the inlet passage and the auxiliary pressurized system, the fluid medium storage device configured to accommodate a portion of the second volume.

12. The valve operating system according to claim 11, wherein the secondary fluid circuit further comprises a second controllable valve assembly configured to regulate a transfer of the portion of the second volume from the fluid medium storage device to the auxiliary pressurized system.

13. The valve operating system according to claim 1, further comprising a control unit configured to operate said auxiliary pressurized system upon a vehicle braking event or a vehicle deceleration event.

14. The valve operating system according to claim 1, wherein said primary fluid circuit comprises a compressor configured to further pressurize the first volume.

15. The valve operating system according to claim 1, wherein said valve operating system is a pneumatic valve operating system.

16. The valve operating system according to claim 1, wherein said cylinder is used as an air compressor during a vehicle braking event or a vehicle deceleration event.

17. The valve operating system according to claim 1, wherein said cylinder is a separate braking compressor cylinder.

18. A vehicle comprising a valve operating system according to claim 1.

19. A method for operating the valve operating system according to claim 1, the method comprising:

compressing the second volume of compressible fluid medium within the cylinder during vehicle braking or vehicle deceleration;

supplying the compressed second volume from the cylinder to the auxiliary pressurized system via the inlet passage;

moving the at least one reciprocating member of the auxiliary pressurized system by means of the compressed second volume; and pressurizing said primary fluid circuit when the moving of the at least one reciprocating member compresses the first volume of compressible fluid medium.

20. A computer readable medium including a computer program configured to perform the method of claim 19.

* * * * *